US011407539B2

(12) United States Patent
Zacherle et al.

(10) Patent No.: US 11,407,539 B2
(45) Date of Patent: Aug. 9, 2022

(54) APPARATUS AND METHOD FOR CONSTRUCTING A PACKAGE

(71) Applicant: WestRock Packaging Systems, LLC, Atlanta, GA (US)

(72) Inventors: Matthew E. Zacherle, Chesterfield, VA (US); Linh L. Kooc, Richmond, VA (US); Lauren N. Chesnet, Henrico, VA (US)

(73) Assignee: WESTROCK PACKAGING SYSTEMS, LLC, Atlanta, GA (US)

( * ) Notice: Subject to any disclaimer, the term of this patent is extended or adjusted under 35 U.S.C. 154(b) by 44 days.

(21) Appl. No.: 17/254,817

(22) PCT Filed: Jun. 17, 2019

(86) PCT No.: PCT/US2019/037436
§ 371 (c)(1),
(2) Date: Dec. 21, 2020

(87) PCT Pub. No.: WO2019/245949
PCT Pub. Date: Dec. 26, 2019

(65) Prior Publication Data

US 2021/0261279 A1 Aug. 26, 2021

Related U.S. Application Data

(60) Provisional application No. 62/687,386, filed on Jun. 20, 2018.

(51) Int. Cl.
*B65B 35/30* (2006.01)
*B65B 17/02* (2006.01)

(52) U.S. Cl.
CPC ..... *B65B 17/025* (2013.01); *B65B 35/30* (2013.01)

(58) Field of Classification Search
CPC ..... B65B 17/025; B65B 35/30; B65D 71/50
(Continued)

(56) References Cited

U.S. PATENT DOCUMENTS 3,680,279 A * 8/1972 Picq ..... B65D 71/70 53/485
4,505,089 A 3/1985 Osteen
(Continued)

FOREIGN PATENT DOCUMENTS

WO 2018/049429 A1 3/2018

OTHER PUBLICATIONS

International Search Report issued in PCT/US2019/037432, dated Sep. 16, 2019.

*Primary Examiner* — Chinyere J Rushing-Tucker
(74) *Attorney, Agent, or Firm* — Neil G. Cohen; Brian J. Goldberg

(57) ABSTRACT

Aspects of the disclosure relate to an apparatus and method of packaging one or more articles. The device being adapted to applying a plurality of top-engaging carriers to a plurality of groups of articles simultaneously. The device comprises a metering base for facilitating arranging a plurality of articles into groups of articles and an applicator for pressing top-engaging carriers onto groups of articles. The metering base comprises a spacer structure for maintaining a predetermined space between each group of articles and at least a next adjacent group of articles; and a first aligning feature. The applicator comprises an applicator plate having a plurality of receiving cavities each for receiving a top of an article and a second aligning feature for engaging the first aligning feature for sliding movement with each other.

20 Claims, 17 Drawing Sheets

(58) Field of Classification Search
USPC ..... 53/398
See application file for complete search history.

(56) References Cited

U.S. PATENT DOCUMENTS

| | | | | | |
|---|---|---|---|---|---|
| 5,221,002 | A * | 6/1993 | Garganese | B65D 71/50 | 294/169 |
| 5,765,684 | A * | 6/1998 | Van Dore | B65D 25/108 | 206/427 |
| 5,791,121 | A | 8/1998 | Bernier | | |
| 6,658,815 | B1 * | 12/2003 | Gaspar | B65D 71/50 | 53/390 |
| 2015/0197357 | A1 * | 7/2015 | Ludwig | B65B 17/02 | 53/48.3 |

* cited by examiner

APPARATUS AND METHOD FOR CONSTRUCTING A PACKAGE

CROSS REFERENCE TO RELATED APPLICATIONS

This application is a U.S. National Phase Application filed under 35 U.S.C. § 371, based on International PCT Patent Application No. PCT/US2019/037436, filed Jun. 17, 2019, which claims priority to U.S. Provisional Patent Application No. 62/687,386 filed on Jun. 20, 2018. The entire contents of these applications is incorporated herein by reference.

TECHNICAL FIELD

The present invention relates to an apparatus for constructing a package, more specifically to an apparatus for attaching one or more carriers or top gripping clips to a group of articles. The present invention also relates to a metering component for metering a plurality of articles into groups, the component each having a series of internal walls arranged to form discrete groups of articles. Even more specifically, but not exclusively, the present invention relates to an apparatus for attaching a set of frangibly connected clips to a plurality of groups of articles, the apparatus comprising an applicator plate arranged such that a frangible connection between adjoined clips is broken to form a plurality discrete packages. Furthermore the invention relates to a method of forming a plurality discrete packages comprising carriers of the top-gripping type having one or more apertures for receiving and retaining an article therein.

BACKGROUND

In the field of packaging it is known to provide cartons for carrying multiple articles. Cartons are well known in the art and are useful for enabling consumers to transport, store and access a group of articles for consumption. For cost and environmental considerations, such cartons or carriers need to be formed from as little material as possible and cause as little wastage in the materials from which they are formed as possible. Further considerations are the strength of the carton and its suitability for holding and transporting large weights of articles. It is desirable that the contents of the carton are secure within the carton.

It is well known to provide top gripping article carriers in which an aperture is formed in a panel of the carrier, wherein tabs are struck from said aperture. The tabs are displaced out of the plane of said panel when an article is received in the aperture, wherein said tabs engage the article generally about a flange or lip of the article.

It is desirable to simplify construction of the blank into a carrier, it is an object of the present disclosure to enable a plurality of connected blanks to be simultaneously assembled into packages. The carrier should be sufficiently robust to withstand the load of the articles. It desirable that the carriers should be capable of packaging generally cylindrical articles, such as but not limited to beverage cans, which articles are of a sleek or slim design.

It is an object of the present disclosure to provide a method and apparatus for simultaneously forming a plurality discrete packages comprising carriers of the top-gripping type having one or more apertures for receiving and retaining an article therein.

The present invention seeks to provide an improvement in the field of cartons, typically formed from paperboard or the like.

SUMMARY

A first aspect of the present disclosure provides a device for applying a plurality of top-engaging carriers to groups of articles respectively. The device comprises a metering base for facilitating arranging a plurality of articles into groups of articles and an applicator for pressing top-engaging carriers onto groups of articles. The metering base comprises a spacer structure for maintaining a predetermined space between each group of articles and at least a next adjacent group of articles and a first aligning feature. The applicator comprises an applicator plate. A plurality of receiving cavities are provided in the applicator plate each for receiving a top of an article. The applicator further comprises a second aligning feature for engaging the first aligning feature for sliding movement with each other.

Optionally, the plurality of top-engaging carriers comprises a set of connected blanks each for forming a top engaging carrier, wherein the blanks are detachably connected together in a matrix fashion wherein each blank has a plurality of top-receiving apertures.

Optionally, the set of connected blanks comprises at least one alignment opening for aligning the set of connected blanks with respect to the metering base.

Optionally, the applicator comprises a separation device for severing frangible connections between adjacent ones of the set of connected blanks.

Optionally, the applicator comprises an end stop for limiting travel of the applicator with respect to the articles.

Optionally, the applicator comprises an end stop for limiting travel of the applicator with respect to the metering base.

Optionally, each of the plurality of receiving cavities in the applicator plate comprises a hole at least partially closed at an upper end thereof.

Optionally, the device comprises at least one riser for elevating one or more articles above a base panel of the metering base.

Optionally, the riser comprises at least one article positioning device for aligning an article.

Optionally, the riser comprises a plurality of article positioning devices for aligning a plurality of articles.

Optionally, the at least one article positioning device comprises a recess defined in an upper surface of the riser.

Optionally, the riser comprises at least one handling device for aligning an article.

Optionally, the riser comprises at least one handling device comprising an orifice disposed in the recess of the at least one article positioning device.

Optionally, the riser comprises at least one handling device for aligning an article located within said at least one article positioning device.

Optionally, the at least one handling device comprises a pair of orifices in the upper surface of the riser.

Optionally, the at least one handling device comprises a pair of cutaways in the upper surface of the riser.

Optionally, the at least one handling device comprises a cutout and an orifice defined in the upper surface of the riser.

Optionally, the at least one article positioning device comprises an upstanding wall defined in an upper surface of the riser.

A second aspect of the present disclosure provides a method of applying a plurality of top-engaging carriers to groups of articles respectively, the method comprising:

(a) providing an application device;

(b) providing a plurality of top-engaging carriers;

(c) placing a plurality of articles into contact with the metering base, whereby arranging the plurality of articles into a plurality of spaced apart groups;

(d) placing the top-engaging carriers over the groups of articles such that the top engaging carriers are guided by the first aligning feature into vertical alignment with the groups of articles respectively;

(e) placing the applicator over the top-engaging carriers such that the first and second aligning features are in engagement with each other to bring the cavities into vertical alignment with the tops of the articles of the groups respectively;

(f) lowering the applicator with respect to the groups of articles so that the top of each article of the groups are received in a respective one of the cavities whereby the top-engaging carriers are also lowered into engagement with the groups of articles respectively; and (g) lifting the applicator to separate the applicator from the groups of articles to which the top-engaging carriers have been applied respectively.

Optionally, providing a plurality of top-engaging carriers comprises providing a set of connected blanks each for forming a top engaging carrier, wherein the blanks are detachably connected together in a matrix fashion wherein each blank has a plurality of top-receiving apertures.

Optionally, lowering the applicator with respect to the groups of articles comprises separating the set of connected blanks from each other.

Optionally, the set of connected blanks comprises two or more alignment openings, wherein the first aligning feature comprises two or more posts projecting upward from the metering base, wherein the step of placing the top-engaging carriers over the groups of articles comprises resting the set of connected blanks upon the articles such that the posts are received in the alignment openings respectively.

Optionally, the alignment openings are provided by cutaways defined in the set of connected blanks, wherein the cutaways are provided in edges of the blanks such that the openings are disposed between a pair of adjacent ones of the blanks.

Optionally, each of the alignment openings is struck in part from each of the pair of adjacent ones of the blanks.

Optionally, each of the alignment openings is provided by a handle aperture in the blanks. Within the scope of this application it is envisaged or intended that the various aspects, embodiments, examples, features and alternatives set out in the preceding paragraphs, in the claims and/or in the following description and drawings may be considered or taken independently or in any combination thereof.

Features or elements described in connection with, or relation to, one embodiment are applicable to all embodiments unless there is an incompatibility of features. One or more features or elements from one embodiment may be incorporated into, or combined with, any of the other embodiments disclosed herein, said features or elements extracted from said one embodiment may be included in addition to, or in replacement of one or more features or elements of said other embodiment.

A feature, or combination of features, of an embodiment disclosed herein may be extracted in isolation from other features of that embodiment. Alternatively, a feature, or combination of features, of an embodiment may be omitted from that embodiment.

BRIEF DESCRIPTION OF THE DRAWINGS

Exemplary embodiments of the invention will now be described with reference to the accompanying drawings, in which.

DETAILED DESCRIPTION OF EMBODIMENTS

Detailed descriptions of specific embodiments of the apparatus, metering component, applicator component, package, blanks, carriers and method of construction are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the apparatus, metering component, applicator component, package, blanks, carriers and method of construction described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 9:
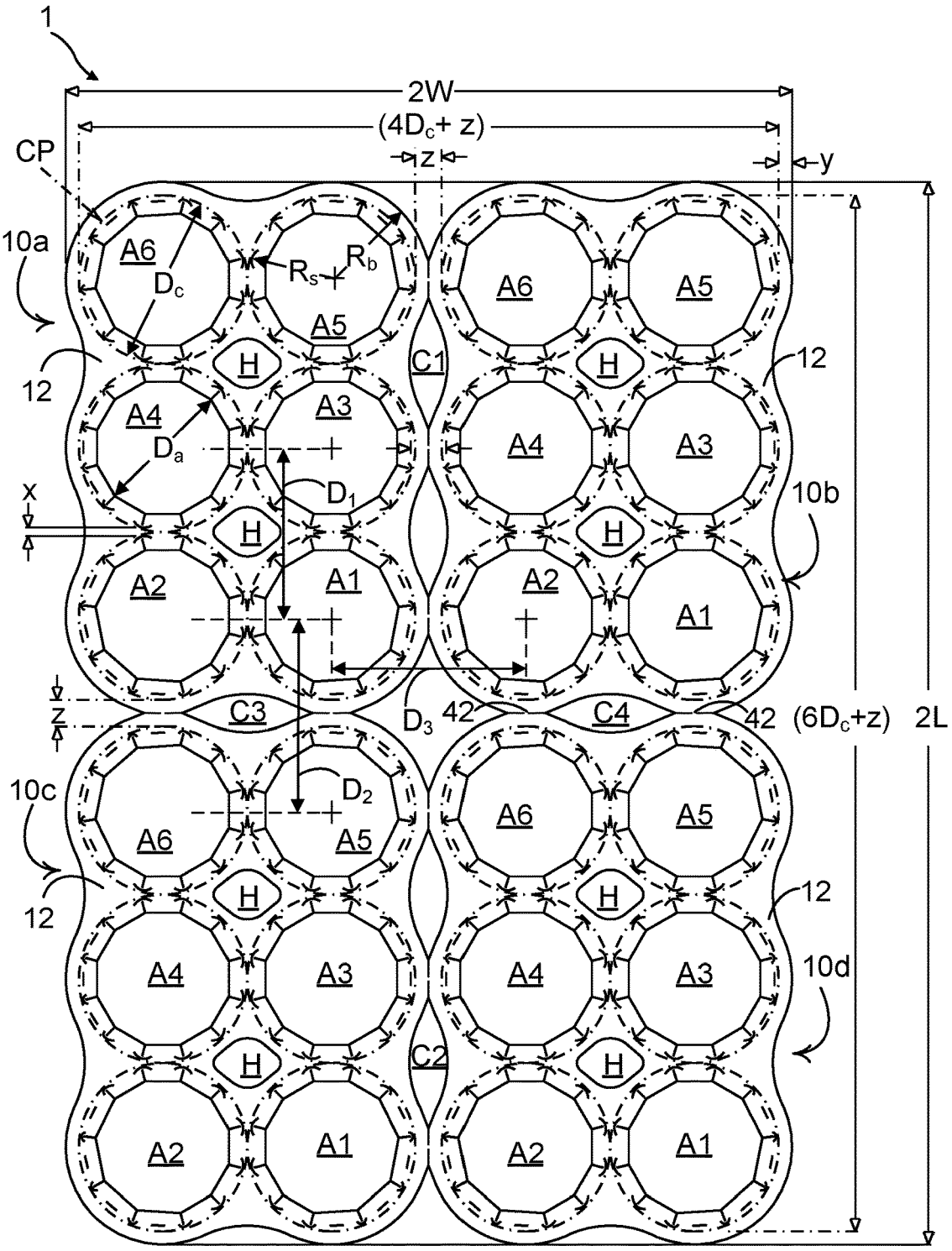
FIG. 9 is a plan view from above of a plurality of connected blanks, each blank for forming a carrier according to a first embodiment.
Figure 11:
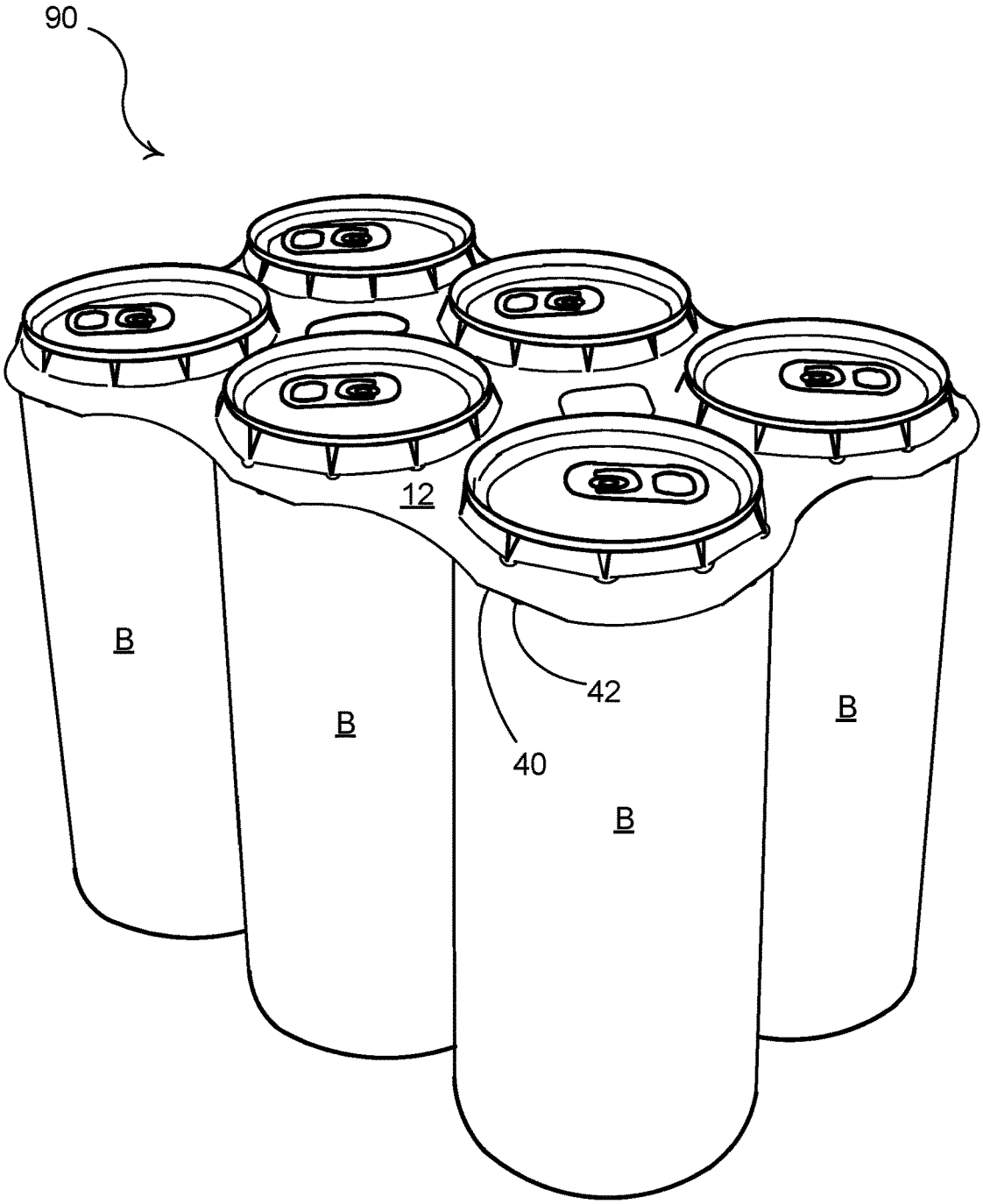
FIG. 11 is a perspective view of a package formed from the blank of FIG. 10.
Figure 12:
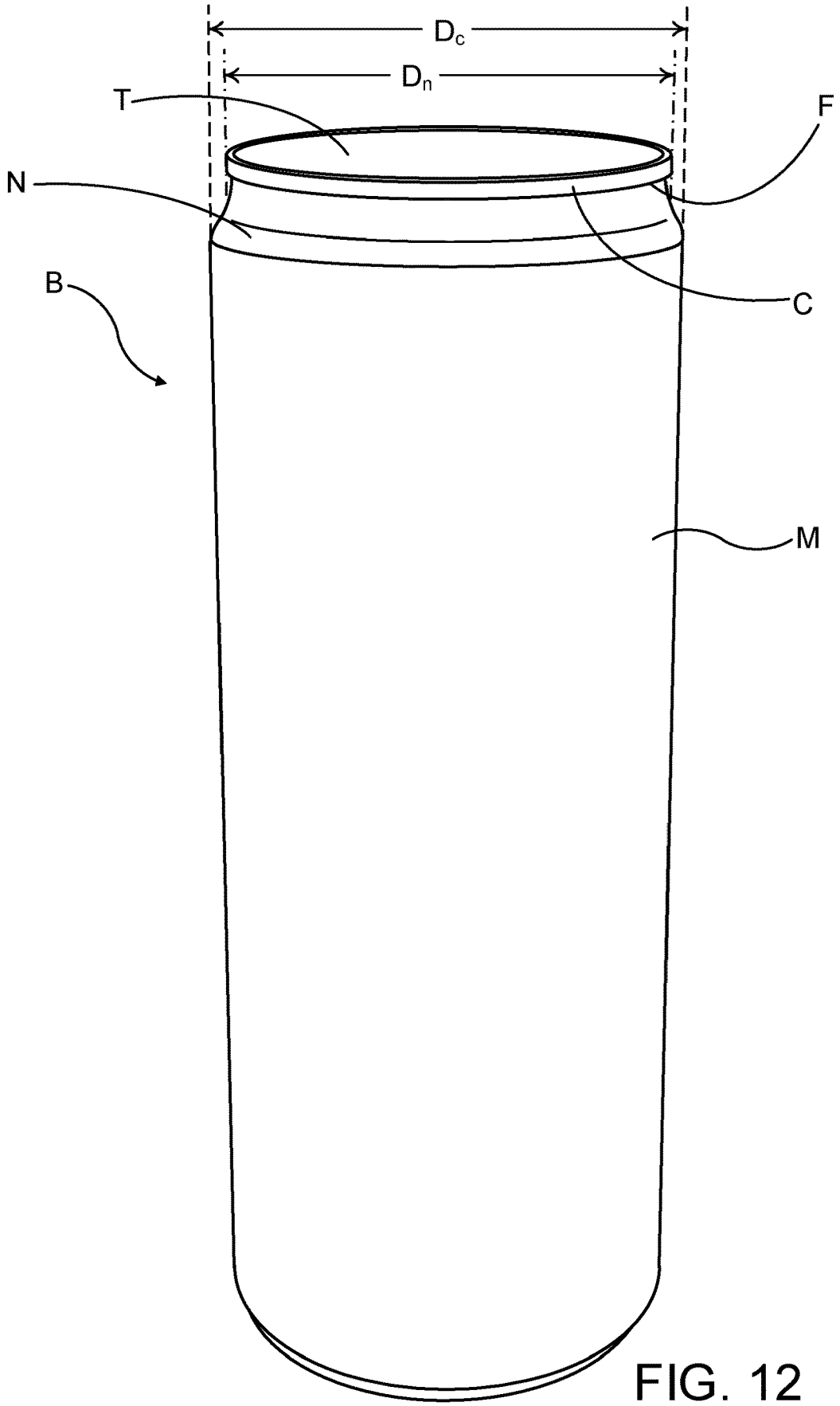
FIG. 12 is a perspective view of a primary product container for use with the carrier of the first embodiment.

Referring to FIG. 9, there is shown a plan view of a plurality of connected blanks 10*a*, 10*b*, 10*c*, 10*d* capable of forming a carton or carrier 90, as shown in FIG. 11, for containing and carrying a group of primary products such as, but not limited to, bottles or cans, hereinafter referred to as articles B, as shown in FIG. 12. The blanks 10*a*, 10*b*, 10*c*, 10*d* form a secondary package for packaging at least one primary product container or package.

In the embodiments detailed herein, the terms "carton" and "carrier" refer, for the non-limiting purpose of illustrating the various features of the invention, to a container for engaging and carrying articles, such as primary product containers. It is contemplated that the teachings of the invention can be applied to various product containers, which may or may not be tapered and/or cylindrical. Exemplary containers include bottles (for example metallic, glass or plastics bottles), cans (for example aluminium cans), tins, pouches, packets and the like.

The blanks 10*a*, 10*b*, 10*c*, 10*d* are formed from a sheet of suitable substrate. It is to be understood that, as used herein, the term "suitable substrate" includes all manner of foldable sheet material such as paperboard, corrugated board, cardboard, plastic, combinations thereof, and the like. It should be recognised that one or other numbers of blanks may be employed, where suitable, for example, to provide the carrier structure described in more detail below.

The packaging structures or cartons described herein may be formed from a sheet material such as paperboard, which may be made of or coated with materials to increase its strength. An example of such a sheet material is tear-resistant NATRALOCK® paperboard made by WestRock Company. It should be noted that the tear resistant materials may be provided by more than one layer, to help improve the tear-resistance of the package. Typically, one surface of the sheet material may have different characteristics to the other surface. For example, the surface of the sheet material that faces outwardly from a finished package may be particularly smooth and may have a coating such as a clay coating or other surface treatment to provide good printability. The surface of the sheet material that faces inwardly may, on the other hand, be provided with a coating, a layer, a treatment or be otherwise prepared to provide properties such as one or more of tear-resistance, good glue-ability, heat sealability, or other desired functional properties.

Figure 4:
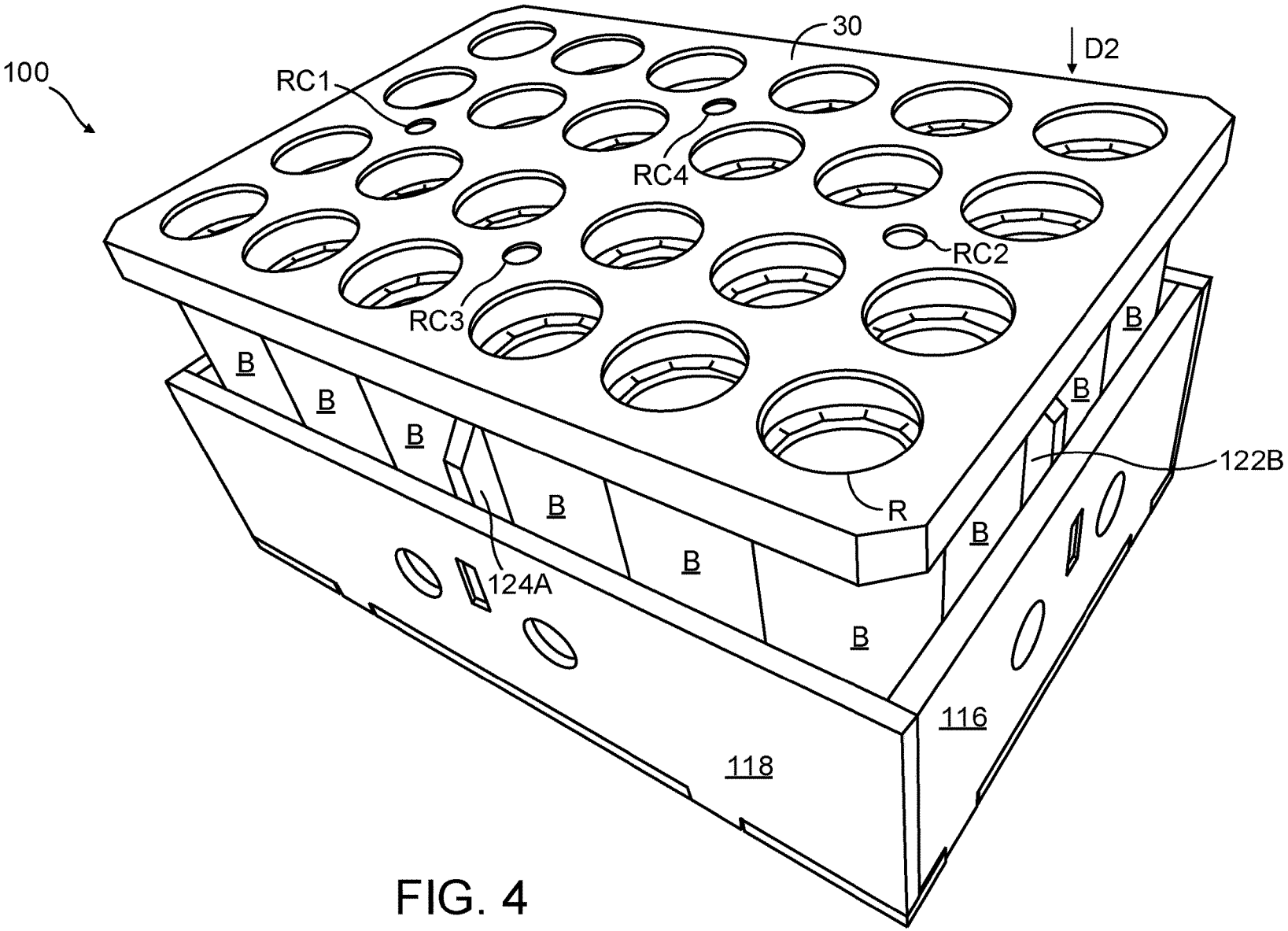

In the illustrated embodiments, the blanks 10*a*, 10*b*, 10*c*, 10*d* are configured to form a carton or carrier 90 for packaging an exemplary arrangement of exemplary articles B. In the embodiment illustrated, each blank 10*a*, 10*b*, 10*c*, 10*d* forms a package having an arrangement in the form of a 2×3 matrix or array; in the illustrated embodiment two rows of three articles are provided, and the articles B are beverage cans. The beverage cans may be 12 oz (355 ml) cans of the sleek or slim design; that is to say the articles B are substantially of the same diameter over their entire height. An exemplary article B is illustrated in FIG. 4, the article B has a maximum diameter or lateral dimension $D_c$ (the diameter $D_c$ may be about 2.25 inches or about 58 mm). The article B comprises an upper portion or top closure T which has a diameter or lateral dimension $D_n$ (the diameter $D_n$ may be about 2.125 inches or 54.8 mm). The neck N may provide an outwardly projecting flange, that is to say it may comprise an undercut for engaging with the carrier. A top closure may be attached to the side wall of the article B to form a seam or "chime" C which provides the flange F. In embodiments of the inventions the variation in diameter between the top closure T and the main body M of the article B is less than 7 mm, may be less than 5 mm and optionally is less than 4 mm.

As used herein the terms "sleek" or "slim" refer to article which have little or no variation in their lateral dimension between the top closure T which engages with the carrier 90 and the main body M of the article B. The articles are substantially parallel sided or of substantially uniform diameter.

Figure 3:
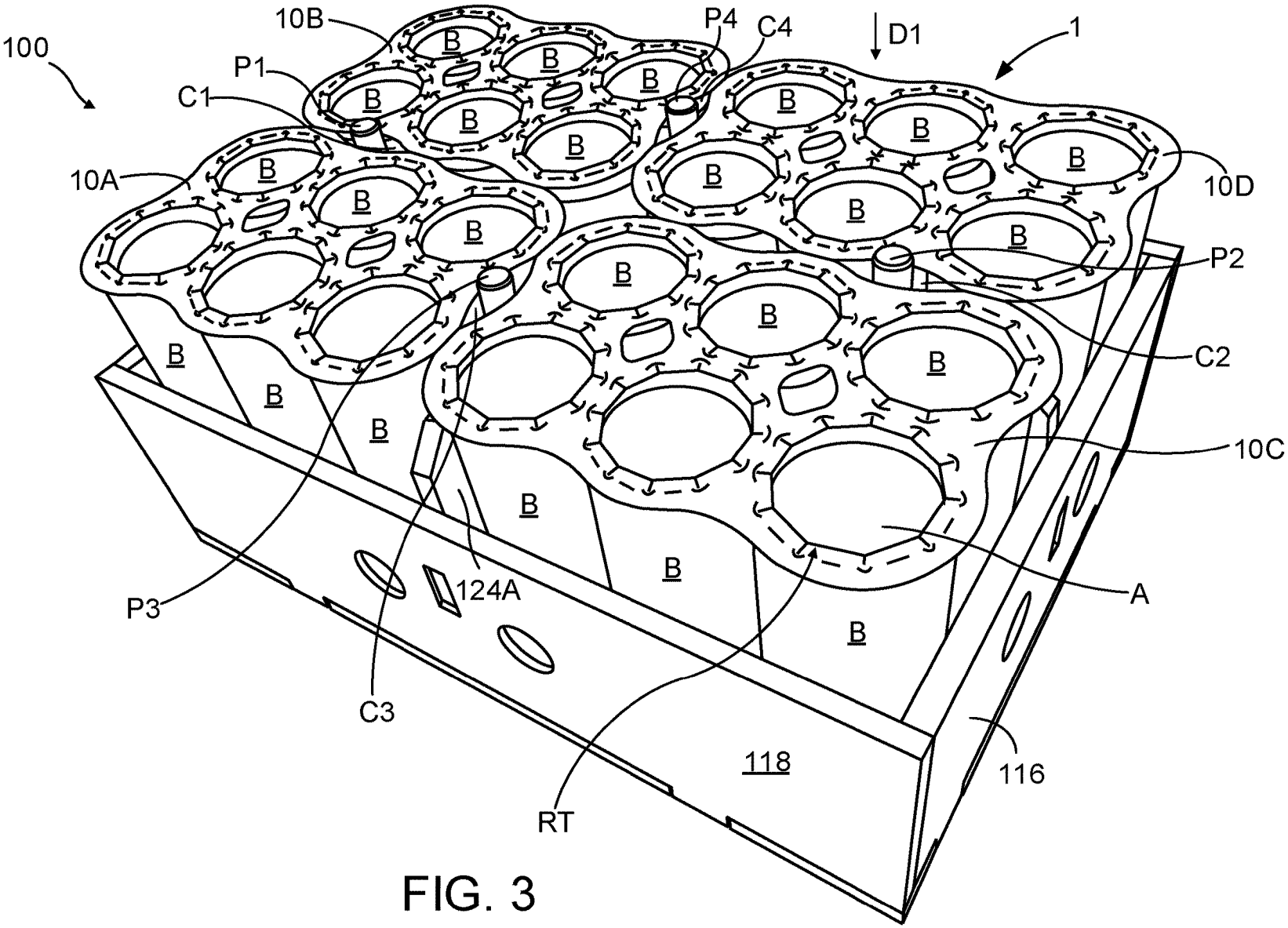

Referring to FIG. 9, there is shown a plurality of connected blanks 1, in the illustrated embodiment there are four blanks 10*a*, 10*b*, 10*c*, 10*d* arranged in a 2×2 matrix or array. Each blank 10*a*, 10*b*, 10*c*, 10*d* is connected to at least two adjacently disposed blanks 10*a*, 10*b*, 10*c*, 10*d* by a frangible or severable connection 42. Each blank 10*a*, 10*b*, 10*c*, 10*d* comprises a main panel 12 for forming a top wall or engaging panel of a carrier 90 (see FIG. 3).

Each of the main panels 12 includes at least one article retention structure RT1, RT2, RT3, RT4, RT5, RT6. In the embodiment of FIG. 9 each main panel 12 comprises a plurality of article retention structures RT1, RT2, RT3, RT4, RT5, RT6, specifically six article retention structures RT1, RT2, RT3, RT4, RT5, RT6 arranged in a 2×3 matrix or array. In other embodiments, alternative arrangements may be employed, for example but not limited to four article retention structures RT1, RT2, RT3, RT4 arranged in a 2×2 matrix or array; in such embodiments the plurality of blanks 10*a*, 10*b*, 10*c*, 10*d* may include six blanks severably connected to form a 2×3 matrix or array. Another alternative arrangement may be three article retention structures RT1, RT3, RT5 arranged in a 1×3 configuration; in such an embodiments the plurality of blanks 10*a*, 10*b*, 10*c*, 10*d* may include eight blanks severably connected to form a 2×4 matrix or array. Another alternative arrangement may be two article retention structures RT1, RT3; or RT1, RT2 arranged in a 1×2 configuration; in such an embodiments the plurality of blanks 10*a*, 10*b*, 10*c*, 10*d* may include twelve blanks severably connected to form a 2×6 or 3×4 matrix or array. Still another alternative arrangement may be four article retention structures RT1, RT2, RT1, RT2 arranged in a 1×4 configuration; in such an embodiments the plurality of blanks 10*a*, 10*b*, 10*c*, 10*d* may include six blanks severably connected to form a 1×6 configuration. Still further alternative arrangement may be eight article retention structures RT1, RT2, RT3, RT4, RT5, RT6, RT1, RT2 arranged in a 2×4 configuration; in such an embodiments the plurality of blanks 10*a*, 10*b*, 10*c*, 10*d* may include three blanks severably connected to form a 1×3 configuration.

Figure 10:
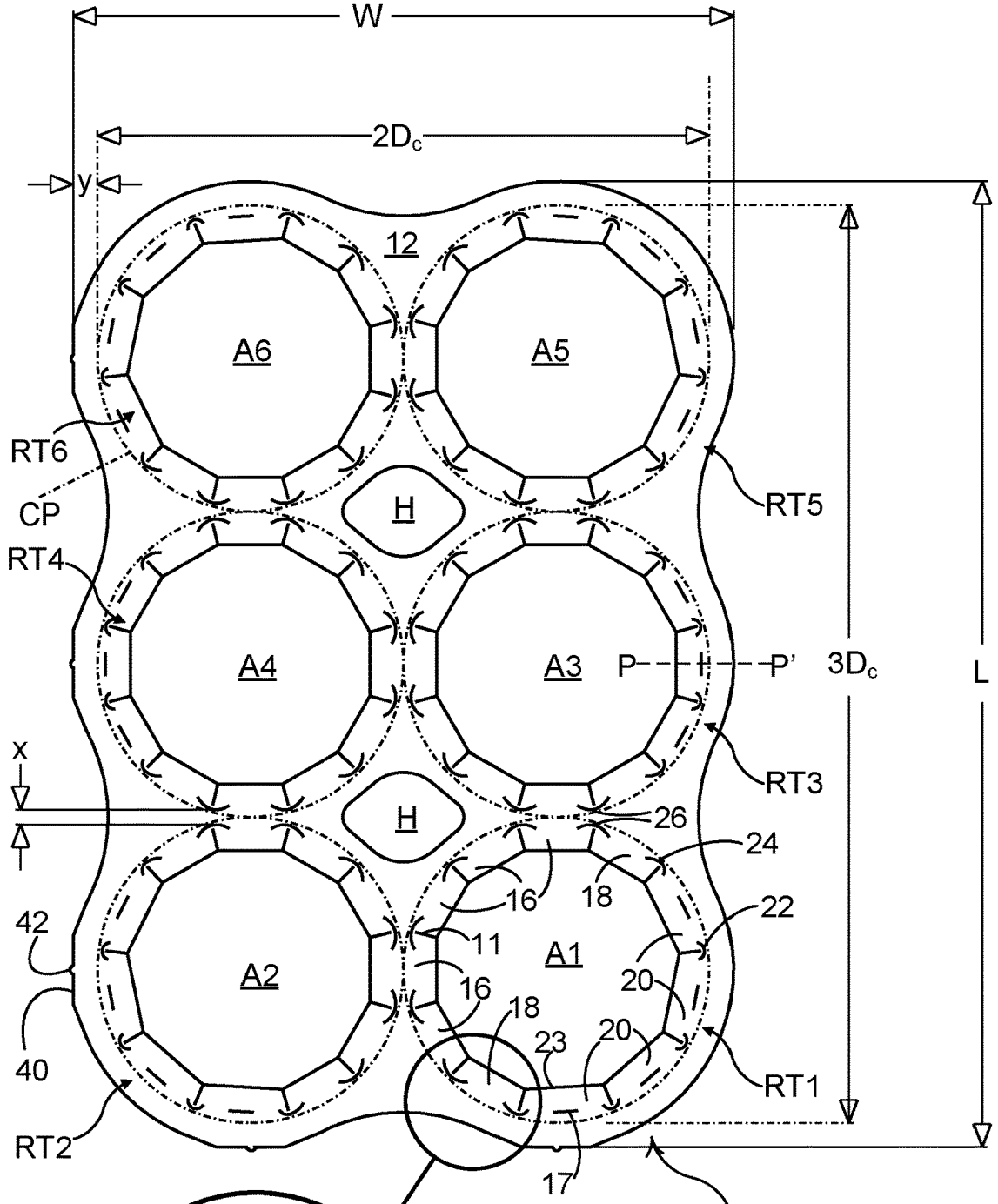
FIG. 10 is a plan view from above of one the blanks of FIG. 9.
Figure 10A:
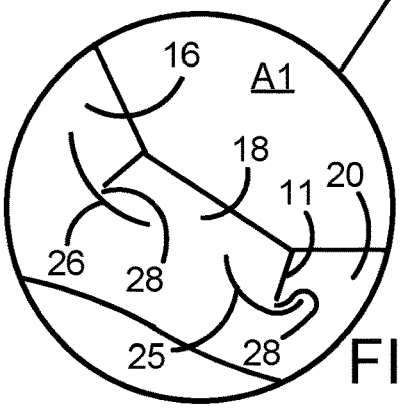
FIG. 10A is an enlarged view of a portion of the blank of FIG. 10.

Each of the article retention structures RT1, RT2, RT3, RT4, RT5, RT6 is substantially similar in construction and will therefore be described in detail with reference to a first article retention structure RT1 as illustrated in FIGS. 10 and 10A. FIG. 10 shows a single blank 10 which has been separated from the plurality of blanks 10*a*, 10*b*, 10*c*, 10*d*. FIG. 10*a* shows an enlarged portion of the blank 10.

The first article retention structure RT1 comprises an aperture A1. The first aperture A1 is an eleven-sided polygon or hendecagon. In other embodiments, other polygonal shapes may be employed.

A plurality of article engaging tabs 16, 18, 20 are arranged about the periphery of the aperture A1. Each tab 16, 18, 20 is hinged to the main panel 12.

Each tab 16, 18, 20 is separated from its adjacent neighbours by a linear cutline 11. In this way each tab 16, 18, 20 comprises a first side edge 19 and a second side edge 21. Each tab 16, 18, 20 comprises a free end edge 23 opposing a hinged edge. The free end edges 23 form engaging edges for retaining an article B, or at least a portion thereof, within the aperture A1. The free end edges 23 each defines a side of the polygonal shape of the first aperture A1. Each of the linear cutlines 11, which define the side edges of the tabs 16, 18, 20, extend from a vertex or corner of the polygonal shape of the first aperture A1. The linear cutlines 11 may be substantially radially arranged with respect to a notional circle that passes through each of the vertices of the polygonal shape of the first aperture A1. The linear cutlines 11 comprise a first proximal end that intersects with a vertex or corner of the polygonal shape of the first aperture A1. The linear cutlines 11 comprise a second distal end.

The plurality of article engaging tabs 16, 18, 20 comprises a series or set of first article engaging tabs 16, a series or set of second article engaging tabs 18, and a series or set of third article engaging tabs 20.

The set of first article engaging tabs 16 are located on the main panel 12 in a region in which the article engaging tabs are subject to the greatest stress or deformation when an article B is received in the first article retention structure RT1.

A first arcuate cutline 26 is disposed proximate each of the linear cut lines 11 defining the side edges of the first article engaging tabs 16. Each first arcuate cutline 26 is spaced apart from the second distal end of the linear cutlines 11 so as to define a connecting portion 28 or "nick" between a pair of adjacent first article engaging tabs 16.

The set of third article engaging tabs 20 are located on the main panel 12 in a region in which the article engaging tabs are subject to the least stress or deformation when an article B is received in the first article retention structure RT1.

A third arcuate cutline 22 is disposed proximate each of the linear cut lines 11 defining the side edges of the third article engaging tabs 20. Each third arcuate cutline 22 is spaced apart from the second distal end of the linear cutlines 11 so as to define a connecting portion 28 or "nick" between a pair of adjacent third article engaging tabs 20. Those connecting portions 28 or "nicks" are provided for maintaining a connection between a pair of adjacent tabs 16, 18, 20 even after an article B is inserted into the aperture A1, A2, A3, A4, A5, A6. The connecting portions 28 connect the respective tab 16, 18, 20 with the next adjacent tab 16, 18, 20, thereby preventing or inhibiting the respective tab 16, 18, 20 from wobbling or rotating about the axis denoted by notional line P-P' or at least mitigating against such wobbling or rotation.

The set of second article engaging tabs 18 are located on the main panel 12 so as to provide a transition between one of the first article engaging tabs 16 and one of the third article engaging tabs 20.

A second arcuate cutline 24, 25 is disposed proximate a cut line 11 separating each of the second article engaging tabs 18 from an adjacent third article engaging tab 20.

Each second arcuate cutline 24, 25 is spaced apart from the second distal end of the linear cutlines 11 so as to define a connecting portion 28 or "nick" between a respective one of the second article engaging tabs 18 and the third article engaging tab 20 adjacent to it.

Each of the first and third arcuate cutlines 22, 26 is arranged symmetrically about the linear cutline with which it is associated. Each of the second arcuate cutlines 24, 25 is asymmetrically arranged about one of the linear cutlines 11.

The first, second and third arcuate cutlines 26, 24, 25, 22 provide stress relief in the main panel 12 when the first, second and third article engaging tabs 16, 18, 20 are displaced out of the plane of the main panel 12.

The first and third arcuate cutlines 26, 22 are arranged symmetrically about the respective linear cutline 11 with which they are associated. The first arcuate cutlines 26 are larger in dimension than the third arcuate cutlines 22. The first arcuate cutlines 26 comprise a first radius of curvature, the third arcuate cutlines 22 comprise a second radius of curvature; the first radius of curvature is larger than the second radius of curvature.

Each of the second cutlines 24, 25 is arranged asymmetrically about the respective linear cutline 11 with which it is associated. The second cutlines 24, 25 comprise a first portion and a second portion contiguously arranged with each other. The first portion is disposed proximate the second article engaging tab 18 and the second portion is disposed proximate a third article engaging tab 20. The first portion of each of the second cutlines 24, 25 comprises a first radius of curvature, the second portion of each of the second cutlines 24, 25 comprises a second radius of curvature; the first radius of curvature is larger than the second radius of curvature.

The second cutlines 24, 25 may be considered to comprise one half of a first arcuate cutline 26 and one half of a third arcuate cutline 22 contiguously arranged with each other.

The second cutlines 24, 25 form asymmetrical 'C'-shaped cuts, whereas the first and third cutlines 26, 22 form symmetrical 'C'-shaped cuts. The second cutlines 24, 25 are employed at the boundary between a first area of the main panel 12 that is subject to higher stress upon displacement of the first article engaging tabs 16 and a second area of the main panel 12 that is subject to lower stress upon displacement of the third article engaging tabs 20. The higher stress area of the main panel 12 occurs where the first tabs 16 are located as these first tabs 16 undergo higher bending stress, when an article B is inserted into the respective aperture A1, A2, A3, A4, A5, A6 than the third tabs 20 disposed in the lower stress area of the main panel 12.

Each of the third article engaging tabs 20 is defined in part by a second linear cutline 17 provided in the main panel 12.

Each second linear cutline 17 is disposed between a pair of adjacent arcuate cutlines 26, 24, 25, 22 in a spaced apart relationship with each of the pair of adjacent arcuate cutlines 26, 24, 25, 22. Each of the third article engaging tabs 20 adjacent to one of the second article engaging tabs 18 comprises a second linear cutline 17 disposed between a first arcuate cutline 26 and second arcuate cutlines 24, 25 in a spaced apart relationship with respect to both the first arcuate cutline 26 and the second arcuate cutlines 24, 25. The remaining third article engaging tabs 20 comprise a second linear cutline 17 disposed between a pair of adjacent first arcuate cutlines 26 in a spaced apart relationship with each of the pair of adjacent first arcuate cutlines 26.

The second linear cutline 17 facilitates folding of each of the third article engaging tabs 20 with respect to the main panel 12.

The second linear cutline 17 defines at least in part a straight or linear fold line 17 by which each of the third article engaging tabs 20 is hinged to the main panel 12.

In the illustrated embodiment the first article retention structure RT1 comprises eleven tabs 16, 18, 20 arranged about the periphery of the aperture A1.

Optionally, the plurality of article engaging tabs 16, 18, 20 may vary in dimension according to their location on the main panel 12. The first article engaging tabs 16 may have a first width, the second article engaging tabs 18 may have a second width and the third article engaging tabs 20 may have a third width. The third width may be greater than the second width which in turn may be greater than the first width. In this way the free end edge 23, which forms an engaging edge E1, E2, of the first tabs 16 is smaller in dimension than the free end edge 23 or engaging edge of the second or third tabs 18, 20.

In the illustrated embodiment, the article engaging tabs 16, 18, 20 located in the region of the main panel 12 and subject to the greatest stress or deformation when an article B is received in the article retention structure RT1, RT2, RT3, RT4, RT5, RT6 are smaller in dimension than the article engaging tabs 16, 18, 20 located in the region of the main panel 12 subject to the least stress or deformation.

The main panel 12 may optionally comprise a handle structure. The handle structure may comprise a pair of handle apertures H. Each of the pair of handle apertures H is struck from the main panel 12. One of the pair of handle apertures H is located in a region disposed centrally between a first pair of article retention structures RT1, RT2 and a second pair of article retention structures RT3, RT4. Said one of the pair of handle apertures H comprises a periphery which periphery is spaced from the centres of each of the apertures A1, A2, A3, A4 by a distance equal to or greater than the maximum diameter $D_c$ of the articles B. The other one of the pair of handle apertures H is located in a region disposed centrally between the and a second pair of article retention structures RT3, RT4 and a third pair of article retention structures RT5, RT6. Said other one of the pair of handle apertures H comprises a periphery which periphery is spaced from the centres of each of the apertures A3, A4, A5, A6 by a distance equal to or greater than the maximum diameter $D_c$ of the articles B.

Optionally, the side and/or end edges of the main panel 12 may be arranged in a curvilinear or undulating shape.

The corners of the main panel 12 are rounded, the corners define an arc having a radius of curvature $R_b$. The arc may be centred on the centre of the aperture A1, A2, A5, A6 of the endmost article retention structures RT1, RT2, RT5, RT6.

The main panel 12 includes at least a paperboard substrate and a tear resistant layer laminated together. It optionally includes an adhesive layer between the paperboard substrate and the tear resistant layer. The material of the paperboard substrate may be selected from any conventional paperboard, for example, ranging in weight upwardly from about 10 pt., preferably from about 11 pt. to about 14 pt. An example of such a substrate is a 12-point SBS board or CNK board manufactured by WestRock Company. The paperboard substrate may be a bleached or unbleached board. The board may be coated on at least one side, optionally the side opposite the lamination, with a conventional coating selected for compatibility with the printing method and board composition.

The tear resistant layer may be disposed over the uncoated side of the paperboard substrate and may be formed of polymeric material and secured to the substrate. The tear resistant layer imparts toughness to the laminate structure. Suitable tear resistant materials may include, but not be limited to, tear resistant laminated sheet material, e.g., NATRALOCK®, which may include a layer of an n-axially oriented film, e.g. MYLAR®, which is a bi-axially oriented polyester, oriented nylon, cross-laminated polyolefin or high density polyolefin. The orientation and cross-laminated structure of these materials contribute to the tear resistant characteristic. Also, tear resistance may be attributed to the chemical nature of the tear resistant material such as extruded metallocene-catalyzed polyethylene (mPE).

Alternatively, the tear resistant layer may be a layer of linear low-density polyethylene (LLDPE). In embodiments where linear low-density polyethylene (LLDPE) or mPE is used, it is not necessary to incorporate an adhesive layer. Other suitable materials having a high level of tear resistance may also be used.

The adhesive layer may be formed of polyolefin material such as a low-density polyethylene (LDPE). The adhesive layer may be placed between the substrate and the tear resistant layer to secure the tear resistant layer to the substrate.

Figure 1:
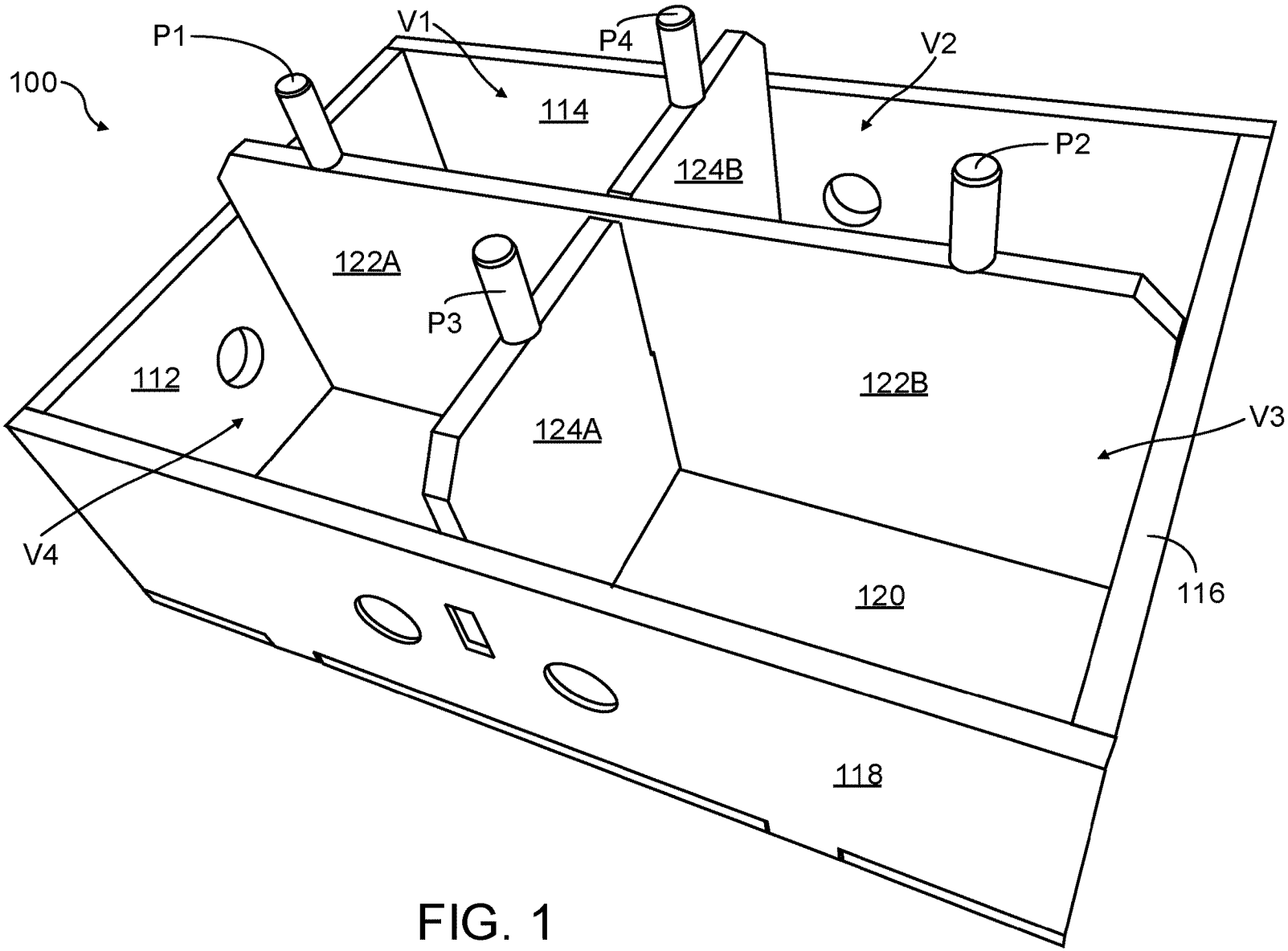
FIG. 1 is a perspective view from above of a metering component for use with an apparatus for constructing plurality of packages.

The positions of the articles B with respect to the blanks 10*a*, 10*b*, 10*c*, 10*d* are indicated by notional lines CP. The notional lines CP indicate the position of the cylindrical wall of the main body of an article B shown in FIG. 4 with respect to the blanks 10*a*, 10*b*, 10*c*, 10*d*. In the embodiment of FIG. 1 the position of twenty-four articles B with respect to the plurality of blanks 10*a*, 10*b*, 10*c*, 10*d* is indicated. The articles B are disposed in four distinct groups of six articles.

Each article B is aligned with one of the apertures A1, A2, A3, A4, A5, A6 of the article retention structure RT1, RT2, RT3, RT4, RT5, RT6 of one of the blanks 10*a*, 10*b*, 10*c*, 10*d*. The tubular axis of the articles B is in registry with the centre of one of the apertures A1, A2, A3, A4, A5, A6.

Each article B with an article group is disposed in touching contact, or in at least close proximity, with at least two adjacent neighbours. The articles B in one group are spaced apart from the nearest adjacent articles B in the neighbouring group by a distance z. This enables each of the adjacently disposed blanks 10*a*, 10*b*, 10*c*, 10*d* to provide a sufficiently thick portion of the main panel 12 about the articles B when the plurality of blanks 10*a*, 10*b*, 10*c*, 10*d* are applied simultaneously to all of the article groups. The spacing apart of the article groups by the distance z is particularly important when packaging articles of the "sleek" or "slim" design as shown in FIG. 12 where there is little or no difference in diameter between the top end closure and/or neck with respect to the side wall of the main body M of the article B.

Figure 2:
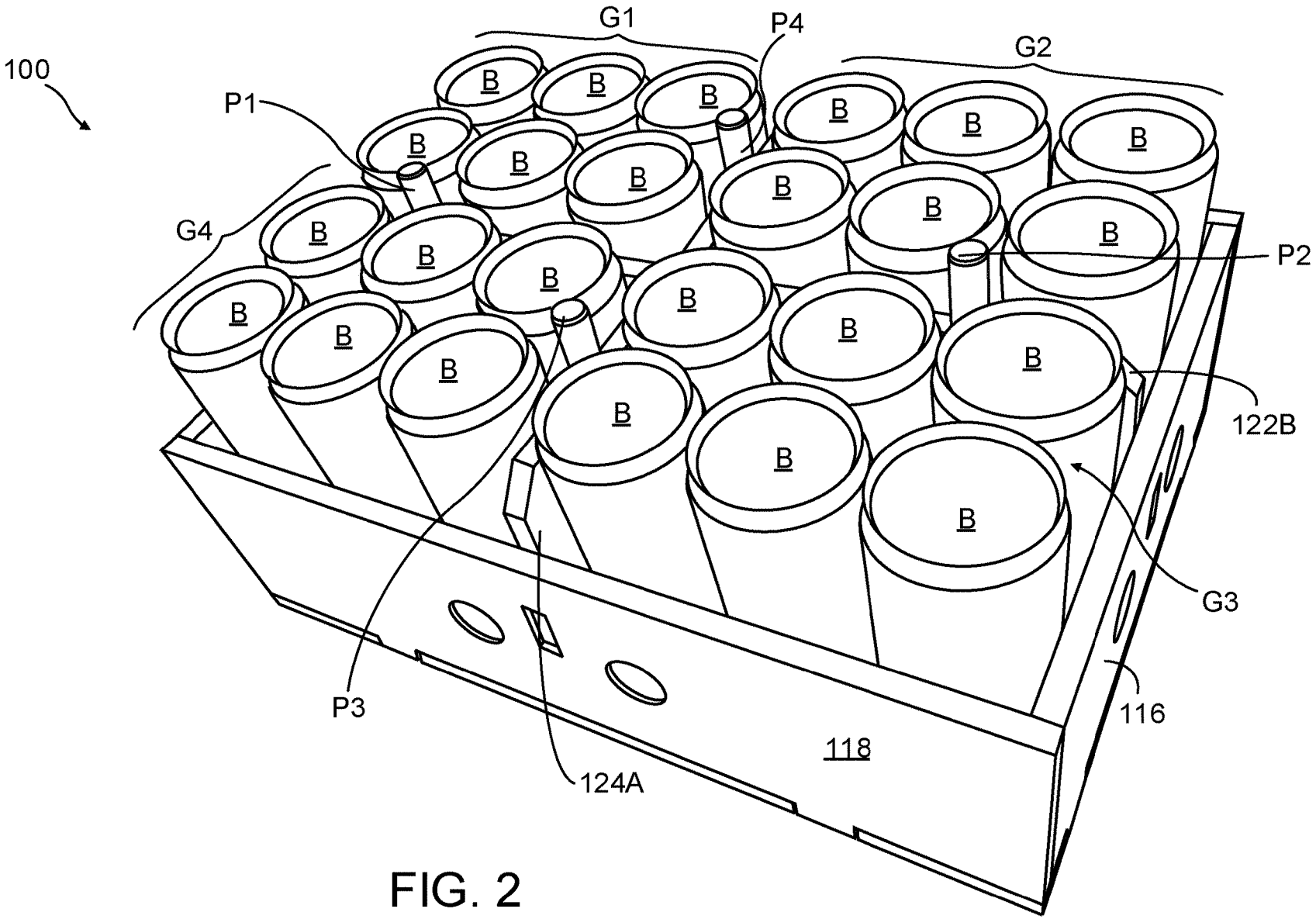
FIGS. 2 to 6 illustrate stages of constructing a plurality of packages using the metering component of FIG. 1.

Each blank 10*a*, 10*b*, 10*c*, 10*d* comprises a maximum width W, as shown in FIG. 2. The main panel 12 is arranged to be wider than the width of the group of articles B which it accommodates, the edge of the main panel 12 is spaced a distance y from the position of the cylindrical side wall CP of the article B, where y=(½z).

The plurality of blanks 10*a*, 10*b*, 10*c*, 10*d* comprises a maximum width 2 W.

Each blank 10*a*, 10*b*, 10*c*, 10*d* comprises a maximum length L, as shown in FIG. 2. The main panel 12 is arranged to be longer than the length of the group of articles B which it accommodates, the edge of the main panel 12 is spaced a distance y from the position of the cylindrical side wall CP of the article B, where y=(½z).

The plurality of blanks 10*a*, 10*b*, 10*c*, 10*d* comprises a maximum length 2 L.

In this way the outer perimeter of the main panel 12, in the flat blank form, is spaced a distance equal to or greater than distance y from the group of articles B as shown in FIG. 2.

The main panel 12 therefore comprises a boundary region surrounding the article group.

The apertures A1, A2, A3, A4, A5, A6 have a maximum lateral dimension or diameter of $D_a$.

The centre of any one of the first, second, third, fourth, fifth and sixth apertures A1, A2, A3, A4, A5, A6 of a given blank 10*a*, 10*b*, 10*c*, 10*d* is spaced from the centre of an adjacent one of the apertures A1, A2, A3, A4, A5, A6 of said blank 10*a*, 10*b*, 10*c*, 10*d* by a dimension $D_1$, dimension $D_1$ may be substantially equal to $D_c$, ($D_1=D_c$). The cylindrical axes of the articles B of a given article group may be similarly spaced apart.

The centre of a first aperture A1 of a first blank 10*a* is spaced from the centre of an adjacent aperture A2, of a second blank 10*b*, by a dimension $D_3$, dimension $D_3$ may be substantially equal to the sum of dimension $D_c$ and dimension z; ($D_3=D_c+z$). The cylindrical axes of the respective articles B may be similarly spaced apart.

The centre of a first aperture A1 of a first blank 10*a* is spaced from the centre of an adjacent aperture A5, of a third blank 10*c*, by a dimension $D_2$, dimension $D_2$, dimension $D_2$ may be substantially equal to the sum of dimension $D_c$ and dimension z; ($D_2=D_c+z$). The cylindrical axes of the respective articles B may be similarly spaced apart.

The cutlines 26 of the first retention structure RT1 are arranged to be spaced at least a distance x from the cutlines 26 of the third retention structure RT1. The cutlines 26 of each retention structure RT1, RT2, RT3, RT4, RT5, RT6 are arranged to be spaced at least a distance x from the cutlines 26 of the an adjacent, retention structure RT1, RT2, RT3, RT4, RT5, RT6.

The distance between the centre of one of the apertures A1, A2, A3, A4, A5, A6 and the outer end of each one of the tabs 16, 18, 20 surrounding the said aperture A1, A2, A3, A4, A5, A6 is given by dimension $R_s$. The outer end of each one of the tabs 16, 18, 20 may be defined by the distal end of the radial cutlines 11. The distance $R_s$ is less than or equal to half the maximum diameter $D_c$ of the articles B, ($R_s \leq ½D_c$). The distance $R_s$ is greater than half the maximum diameter $D_a$ of the apertures A1, A2, A3, A4, A5, A6, ($R_a > ½D_a$).

The article retention structure RT1, RT2, RT3, RT4, RT5, RT6 each define an opening which is formed in part from a respective one of the apertures A1, A2, A3, A4, A5, A6 and from the plurality of article engaging tabs 16, 18, 20 associated with each aperture A1, A2, A3, A4, A5, A6. The opening comprises a diameter or maximum lateral dimension which may be less than the maximum diameter $D_c$ of the article B to be received therein.

Referring again to FIG. 1 each of the corners of the blanks 10*a*, 10*b*, 10*c*, 10*d* may be rounded in shape. The rounded corners may be defined by a corner radius $R_b$. The corner radius $R_b$ is greater than half the maximum diameter $D_c$ of the articles B ($R_b > ½D_c$). In some embodiments, the corner radius $R_b$ is ⅛ inches (3.175 mm) larger than half the maximum diameter $D_c$ of the articles B, in other embodiments the corner radius $R_b$ is more than ⅛ inches (3.175 mm) larger than half the maximum diameter $D_c$ of the articles B.

The dimensions $D_2$, $D_3$ may be generally equal to twice the corner radius $R_b$, ($D_2=D_3 \approx 2R_b$).

The dimensions $D_2$, $D_3$ are greater than the dimension $D_1$, ($D_1<D_2$; $D_1<D_3$).

Each of the handle apertures H are arranged to be in registry with a void between four adjacently disposed articles B. Each of the handle apertures H comprises an outline defining an edge of the main panel 12.

Each of the plurality of blanks 10*a*, 10*b*, 10*c*, 10*d* is severably connected to adjacently disposed ones of the plurality of blanks 10*a*, 10*b*, 10*c*, 10*d* by a connecting bridge portion or connecting nick 42. The adjacently disposed blanks may be in touching contact over a short linear section 40, see FIG. 2, of the outer edge of the blanks 10*a*, 10*b*, 10*c*, 10*d*.

Turning to the construction of the carrier 90 from the blank 10, the plurality of blanks 10*a*, 10*b*, 10*c*, 10*d* may be applied to a plurality of groups of articles B. The plurality of blanks 10*a*, 10*b*, 10*c*, 10*d* is lowered with respect to the groups of articles B. Each of the article retention structures RT1, RT2, RT3, RT4, RT5, RT6 of each of the plurality of blanks 10*a*, 10*b*, 10*c*, 10*d* is aligned with a respective article B in one of the groups of articles B. Portions of the articles B pass through the main panels 12. The tabs 16, 18, 20 of each of the article retention structures RT1, RT2, RT3, RT4, RT5, RT6 are folded out of the plane of the main panels 12 and engage beneath the chime C (which may provide a flange F, see FIG. 12) of an article B. In this way, the tabs 16, 18, 20 grip or hold the article B and prevent or inhibit the articles B from unintentionally separating from the main panels 12. The assembled carrier 90 is shown in FIG. 11.

Figure 5:
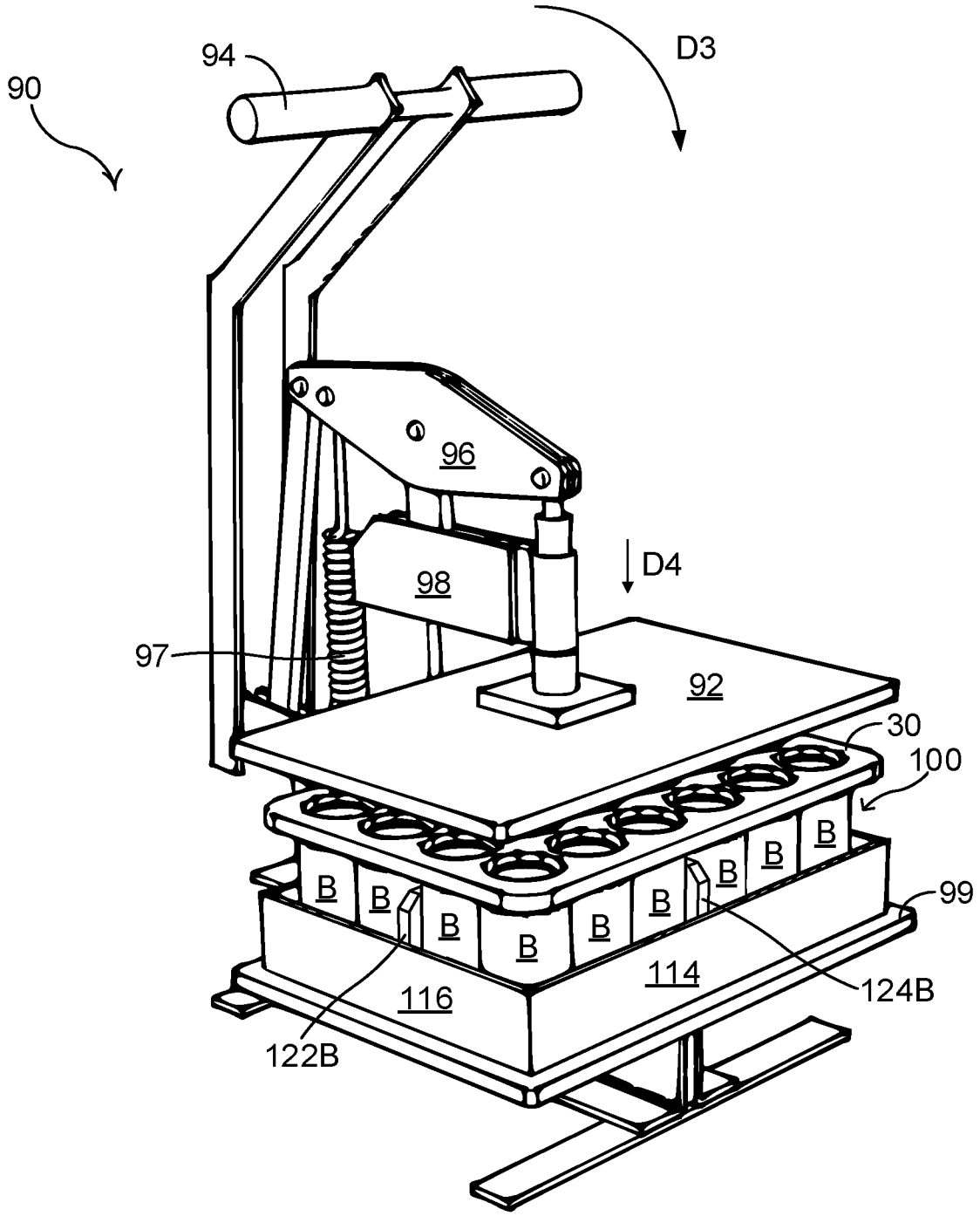

FIG. 1 illustrates a base or metering component 100 forming part of an apparatus 80, shown in FIG. 5 for constructing a plurality of packages.

The apparatus 80 facilitates attachment of a set of plurality of connected blanks 1 to a plurality of discrete groups of articles G1, G2, G3, G4, such as cans 'B'. The apparatus 80 comprises an applicator plate 30 (see FIGS. 4, 5, 7A, 7B and 8) which is described in further detail below.

The metering component 100 (see FIG. 1) is structured and arranged for receiving a plurality of articles B and for dividing the plurality of articles B into a plurality of groups G1, G2, G3, G4. The metering component 80 maintains each group G1, G2, G3, G4 in a spaced apart relationship to its adjacent neighbouring groups G1, G2, G3, G4.

The apparatus 80 comprises a mould or die in the form of an applicator 30 which forms the blanks 10*a*, 10*b*, 10*c*, 10*d* into top gripping clips 90 each retaining one of the groups of articles G1, G2, G3, G4.

The apparatus 80 also comprises a reciprocating element and a base plate 99. The reciprocating element is optionally coupled to the applicator plate 30. The reciprocating element is operable to move the applicator plate 30 downward towards the base plate 99 and upward away from the base plate 99.

Figure 8:
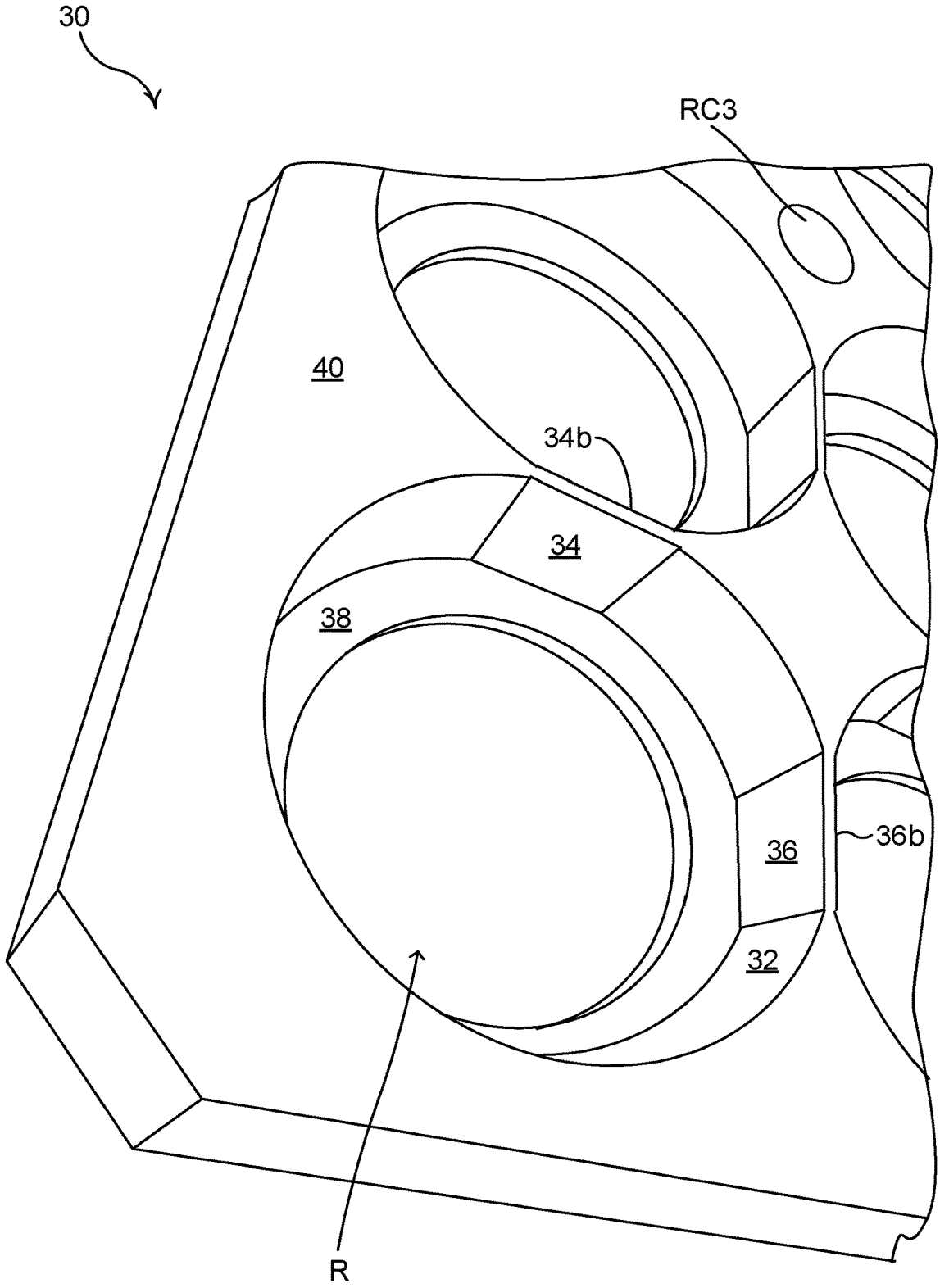
FIG. 8 is a perspective view from below of portion of the applicator component of FIG. 7A.

The applicator plate 30 comprises a main body or plate which is generally rectangular, optionally the corners are chamfered or bevelled. The plate comprises a plurality of cavities or receivers R. In the illustrated embodiment the receivers R take the form of an orifice in a lower surface of the plate. The orifice may extend through the plate to the upper surface. The orifice may be a blind hole or as illustrated in FIG. 8 may be partially closed by a reduction in the lateral dimension of the aperture. In this way the receiver R comprises an end stop 38 which limits or inhibits the passage of an article through the orifice. The end stop 38 comprises an aperture having lateral dimension or diameter of d2. The end stop 38 is disposed proximate the upper end of the plate in normal use. The orifice in the lower surface of the plate comprises an aperture having lateral dimension or diameter of d1, d1 is larger in dimension than d2, d1>d2.

The receivers R are arranged in groups G1, G2, G3, G4. Each group comprising six receivers in the illustrated embodiment, arranged in a 2×3 matrix or array. The illustrated embodiment comprises four groups G1, G2, G3, G4 the groups are arranged in a 2×2 matrix or array.

The orifice may be substantially circular in shape, in other embodiments the orifice may be polygonal in shape for example, but not limited to, eleven-sided polygon or hendecagon.

In the illustrated embodiment the orifice is generally circular and comprises a flattened or planar portion 34, 36, see FIG. 8, in regions where the orifice is in close proximity to an adjacent orifice in the plate. In this way the orifice take the form of a truncated circle, the circle being truncated at least two regions of its perimeter.

The flattened or planar portions 34, 36 define, at least in part, a part of the die 30 which is inserted between upper ends of two adjacently disposed articles B. In other embodiments in which the main body M of the article B is sufficiently larger than the top closure T, or in embodiments in which the articles B within a group G1, G2, G3, G4 are spaced apart from each other, the orifices of the receiver may be circular in shape, the flattened or planar portions 34, 36 may be omitted.

Figure 7B:
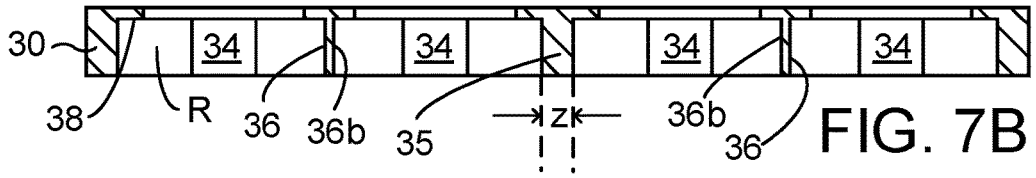
FIG. 7B is a sectional view of the applicator component along the line A-A shown in FIG. 7A.
Figure 7A:
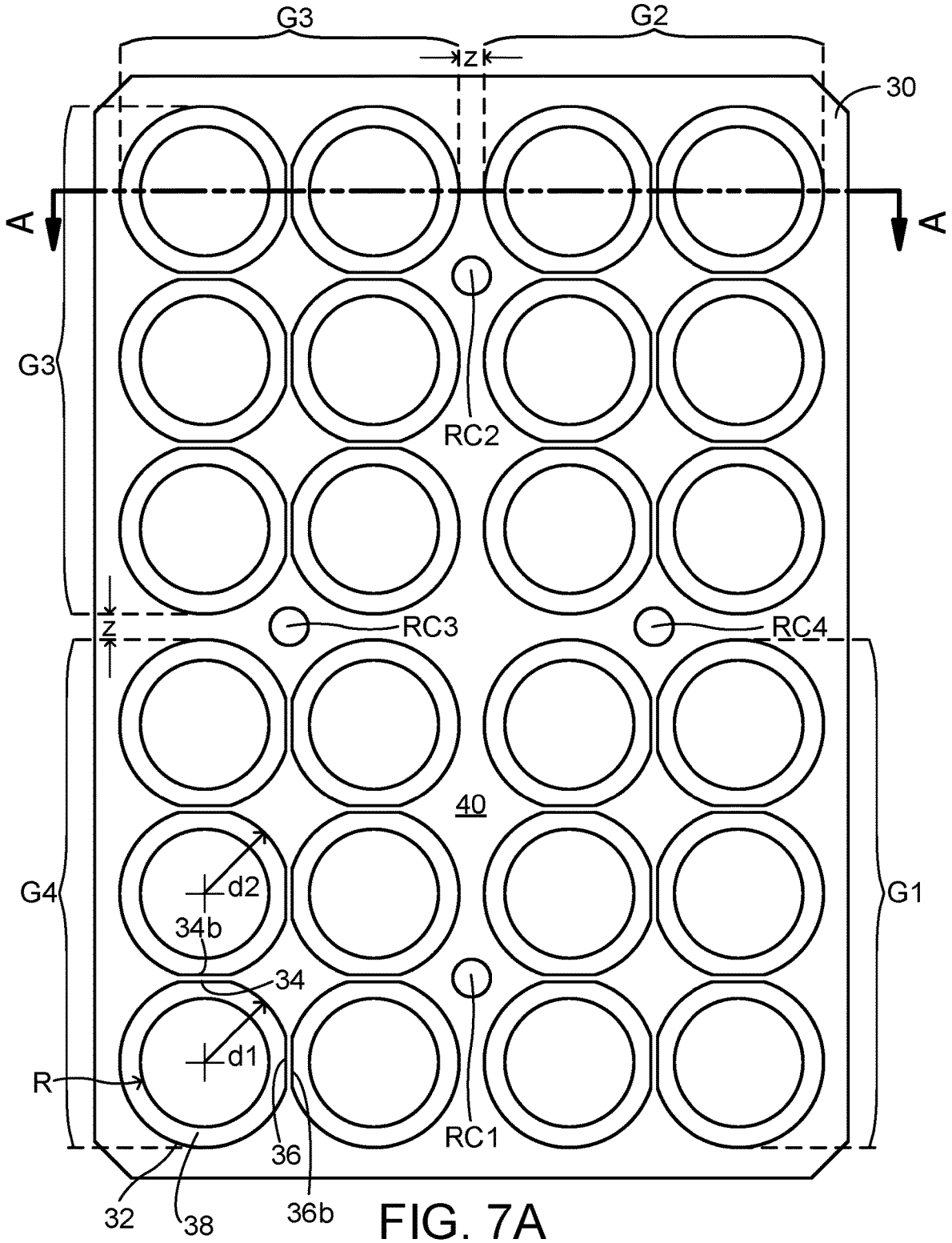
FIG. 7A is a plan view from below of an applicator component for use with the metering component of FIG. 1.

The applicator 30 comprises at least one separator device 35, see FIG. 7B. In the illustrated embodiment the applicator 30 comprises ten separator devices 35 each arranged to sever one of the frangible connections between pairs of adjacent blanks of the plurality of connected blanks 1.

As shown in FIG. 1 the metering component 100 comprises a plurality of external walls including opposed sidewall 114, 118 and opposed end walls 112, 116 and a base 120 which define a tray having an interior. The metering component 100 comprises an open top. The metering component 100 comprises a plurality of internal walls 122*a*, 122B, 124A, 124B which divide the interior of metering component 100 in to a plurality of chambers V1, V2, V3, V4, in the illustrated embodiment the metering component 100 comprises four chambers V1, V2, V3, V4. The plurality of internal walls 122*a*, 122B, 124A, 124B form a metering device in the tray.

A plurality of articles B can be loaded into the interior of the metering component 100 onto the base 120. A plurality of article groups G1, G2, G3, G4 are formed, see FIG. 2. A first article group G1 is formed in a first chamber V1. A second article group G2 is formed in a second chamber V2. A third article group G3 is formed in a third chamber V3. A fourth article group G4 is formed in a fourth chamber V4.

A first internal wall 122A separates the first chamber V1 from the fourth chamber V4. A second internal wall 122B separates the second chamber V2 from the third chamber V3. A third internal wall 124A separates the first chamber V1 from the second chamber V2. A fourth internal wall 124B separates the third chamber V3 from the fourth chamber V4.

The first internal wall 122A spaces apart the first article group G1 from the fourth article group G4. The second internal wall 122B spaces apart the second article group G2 from the third article group G3. The third internal wall 124A spaces apart the first article group G1 from the second article group G2. The fourth internal wall 124B spaces apart the third article group G3 from the fourth article group G4.

The internal walls 122A, 122B, 124A, 124B provide spacer elements of a spacer structure to meter or divide the articles B into groups. In other embodiments the spacer elements may take a different form for example but not limited to posts or pillars mounted to the base of the metering component 100. In still other embodiments the base panel 120 of the metering component 100 may comprise recesses or blind holes or orifices arranged to receive lower portions of the articles B.

When the apparatus 80 is operational and the applicator plate 30 is lowered down onto the tops of the articles 'B' and is located thereon, the articles 'B' are prevented or inhibited from moving, and their relative locations are not disturbed, the set of connected blanks 1 is fixed in position with respect to the metering component 100 and the articles B disposed therein, thus enabling the applicator plate 30 to locate or align correctly with the articles B and the blanks 10*a*, 10*b*, 10*c*, 10*d*. In this way the blanks 10*a*, 10*b*, 10*c*, 10*d* form a set of top gripping clips or carriers 90.

Figure 6:
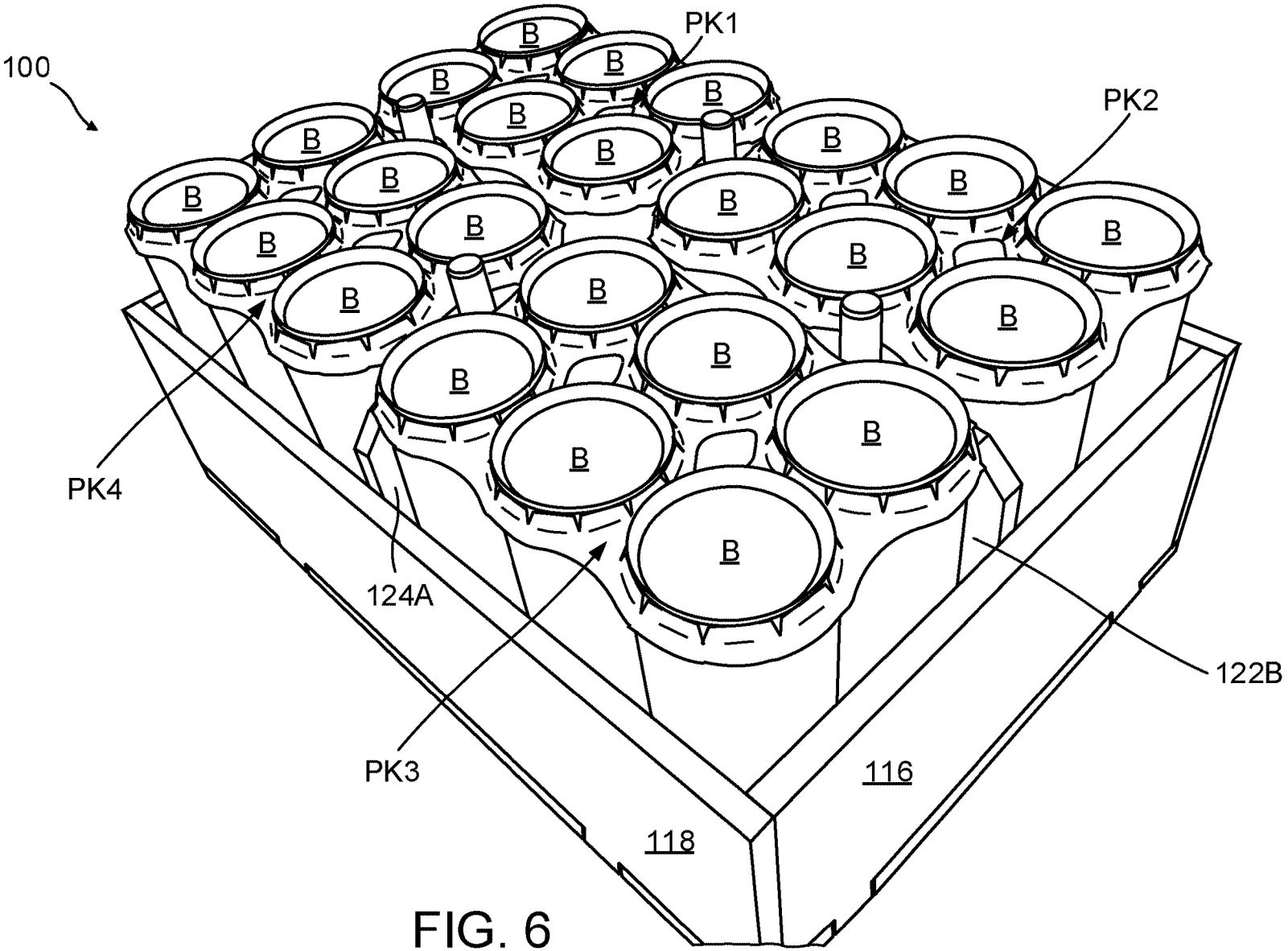

The applicator plate 30 is structured and arranged to locate and mount the set of frangibly joined blanks 1 with respect to the plurality of groups of articles G1, G2, G3, G4. The applicator plate 30 is structured and arranged to break the frangible connections 42 between blanks 10*a*, 10*b*, 10*c*, 10*d* of the set of connected blanks 1 in order to form a plurality of discrete packages PK1, PK2, PK3, PK4, see FIG. 6. In this illustrated arrangement four discrete groups of six articles, each clipped together in a 2×3 arrangement are formed.

The reciprocating element comprises a handle 94, a lever arm 96 and a spring 97 (for example but not limited to a coil spring—the spring 97 provides a resilient biasing device), coupled together such that movement of the handle 94 causes the spring 97 to contract or extend which causes the top or pressure plate 92 and applicator plate 30 (coupled thereto) to be lifted up away from or moved down towards the base plate 99. The handle 94 may be coupled by via one or more handle limbs to a lower end of the spring 97. An upper end of the spring 97 may be coupled to a first end of the lever arm 96. The lever arm 96 may pivot about a central fulcrum. A second end of the lever arm 96 may be coupled to the pressure plate 92 by a rod; the rod may be slidably mounted to frame element.

The metering component 100 comprises a plurality of posts P1, P2, P3, P4. The posts P1, P2, P3, P4 form an alignment guide. The alignment guide forms a first aligning feature which is part of a complementary alignment device. The alignment guide facilitates alignment of the set of connected blanks 1 with respect to the plurality of groups of articles G1, G2, G3, G4. In the illustrated embodiment each of the internal walls 122A, 122B, 124A, 124B comprises a post P1, P2, P3, P4 mounted to an upper surface thereof. The posts P1, P2, P3, P4 are located and arranged so as to be receivable in an opening in the set of connected blanks 1. The upper end of the posts P1, P2, P3, P4 may be tapered or reduced in diameter.

In alternative embodiments, the posts P1, P2, P3, P4 may be mounted to the base panel 120, the posts P1, P2, P3, P4 may be arranged to be located in a void or gap between four adjacently disposed articles B. In some embodiments the posts P1, P2, P3, P4 may be configured and arranged to employ the handle apertures H of the blanks 10*a*, 10*b*, 10*c*, 10*d* for aligning the set of connected blanks 1 with respect to the plurality of groups of articles G1, G2, G3, G4.

Once the metering component 100 is loaded with articles B the set of connected blanks 1 is placed upon the loaded metering component 100, the set of connected blanks 1 rests upon the articles B. Each of the posts P1, P2, P3, P4 is received in an alignment opening provided by a cutaway C1, C2, C3, C4 defined in the set of connected blanks 1. The cutaways C1, C2, C3, C4 are provided in edges of the blanks 10*a*, 10*b*, 10*c*, 10*d* such that the openings are disposed between a pair of adjacent blanks 10*a*, 10*b*, 10*c*, 10*d*; the openings may be considered to be struck in part from each of said pair of adjacent blanks 10*a*, 10*b*, 10*c*, 10*d*. In other embodiments, the alignment opening may be provided by a handle aperture in the blanks 10*a*, 10*b*, 10*c*, 10*d*. In such embodiments the posts P1, P2, P3, P4 may be mounted to an appropriate portion of the base panel 120.

The applicator plate 30 may also be referred to as an "applicator mould" since it is a component that is structured and arranged to mould and form the top gripping clip onto the group of articles 88.

The applicator plate 30 comprises a second aligning feature forming part of the complementary aligning device. The second aligning feature takes the form of orifices, holes or apertures RC1, RC2, RC3, RC4 in the lower surface of the applicator plate 30, the apertures may extend through the applicator plate 30 to the upper surface or may be blind. The apertures define a cavity or bore into which one of the plurality of posts P1, P2, P3, P4 may be received.

In alternative embodiments, the second aligning feature may take the form of posts or pins extending from a lower surface of applicator plate 30. The base 100 may comprises complementary holes provided in the upper surface of the internal walls 122*a*, 122B, 124A, 124B or alternatively provided in the base panel 120.

When the posts P1, P2, P3, P4 of the first aligning feature are received in the holes or apertures RC1, RC2, RC3, RC4 of the second aligning feature the applicator plate 30 is aligned to the base 100 and in turn to the set of connected blanks 1 and the articles B loaded in the base 100.

In this way the applicator plate 30, the set of connected blanks 1 and the articles B are each or all aligned with respect to the base 100.

This enables the set of connected blanks 1 to be applied to the loaded base 100, that is to say the metering component 100 loaded with articles B, prior to engaging the applicator plate 30 with set of connected blanks 1. This may be advantageous since a single applicator plate 30 could be employed with a plurality of bases 100. In this way while the applicator plate 30 is engaged with a first loaded base 100 a second base 100 may be loaded with articles B and aligned with a set of connected blanks 100. This may allow the throughput of the apparatus to be increased The apparatus 80 may comprise a drive means for moving the reciprocating element 82 up and down, thus avoiding manual articulation using a handle (which would not be required). Such an arrangement may incorporate a motor, a piston and/or other suitable electro mechanical components to facilitate automated lifting and lowering of the applicator plate 10. However, in the present operation, the apparatus is manually operated.

In alternative embodiments, the apparatus 80 may be adapted to accommodate two or more bases 100 and applicator plates 30 simultaneously, the top plate 92 and base plate 99 sized accordingly.

Referring in particular to FIG. 11, each of the blanks 10*a*, 10*b*, 10*c*, 10*d* form a top engaging carrier 90, only one of which is shown, comprising a main panel 12 which comprises apertures A1, A2, A3, A4, A5, A6 each receiving a portion of a respective article B. The main panel 12 further comprises an annular series of tabs 16, 18, 20 formed around each of the first and second apertures A1, A2, A3, A4, A5, A6. The tabs 16, 18, 20 of each annular series are connected to the main panel 12 such that the tabs 16, 18, 20 yield out of the plane of the main panel 12, about fold lines 31, when an article B is received in the respective aperture A1, A2, A3, A4, A5, A6 so as to bear against the article B.

Another optional feature of the carrier 90 is that the main panel 12 is defined by a perimeter including convexly curved edges and concavely curved edges, wherein the radius of curvature of the convexly curved edges is substantially equal to the radius of curvature of the concavely curved edges.

Figure 13:
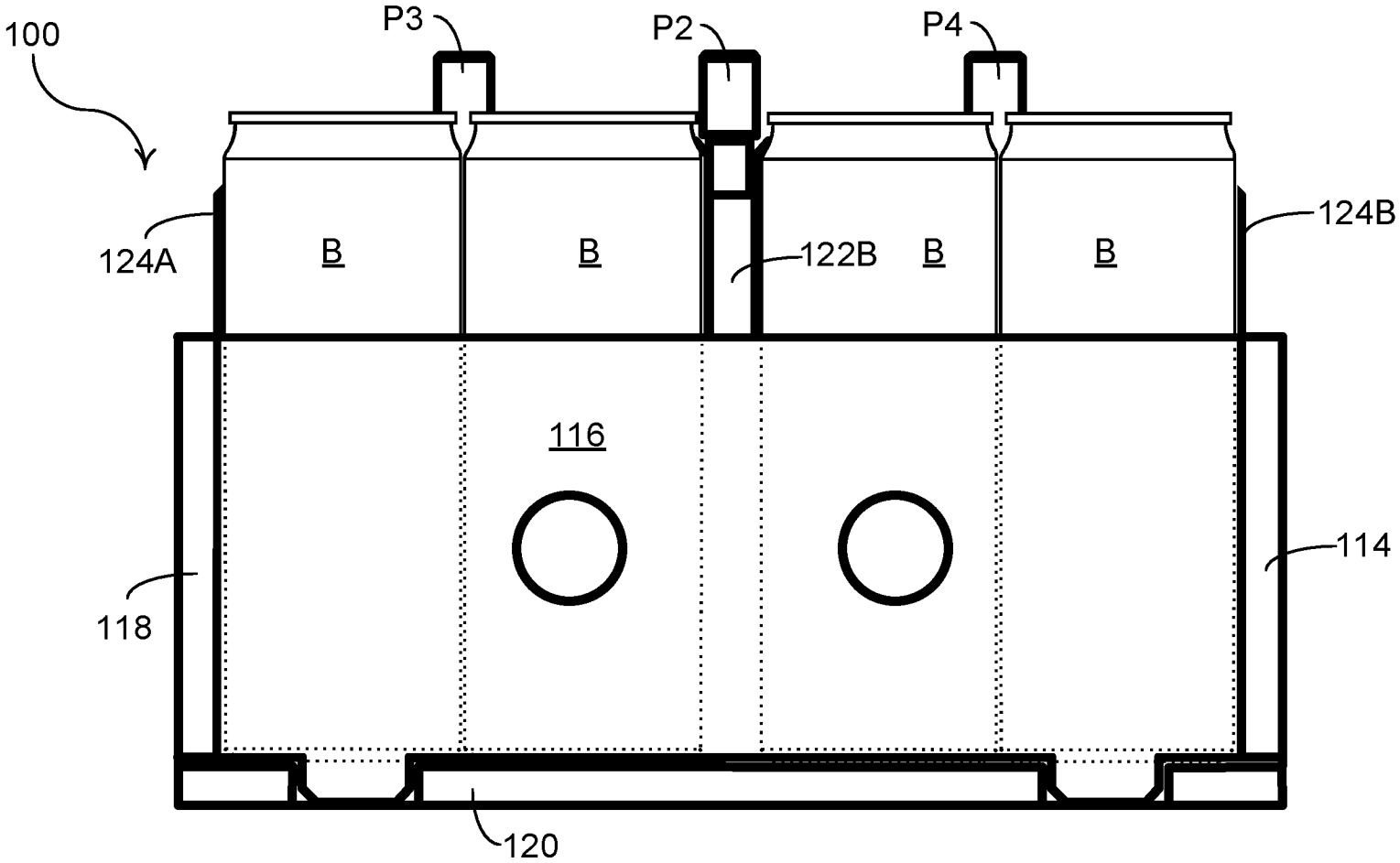
FIG. 13 is an end view of the metering component of FIG. 1 loaded with a plurality of articles.
Figure 14:
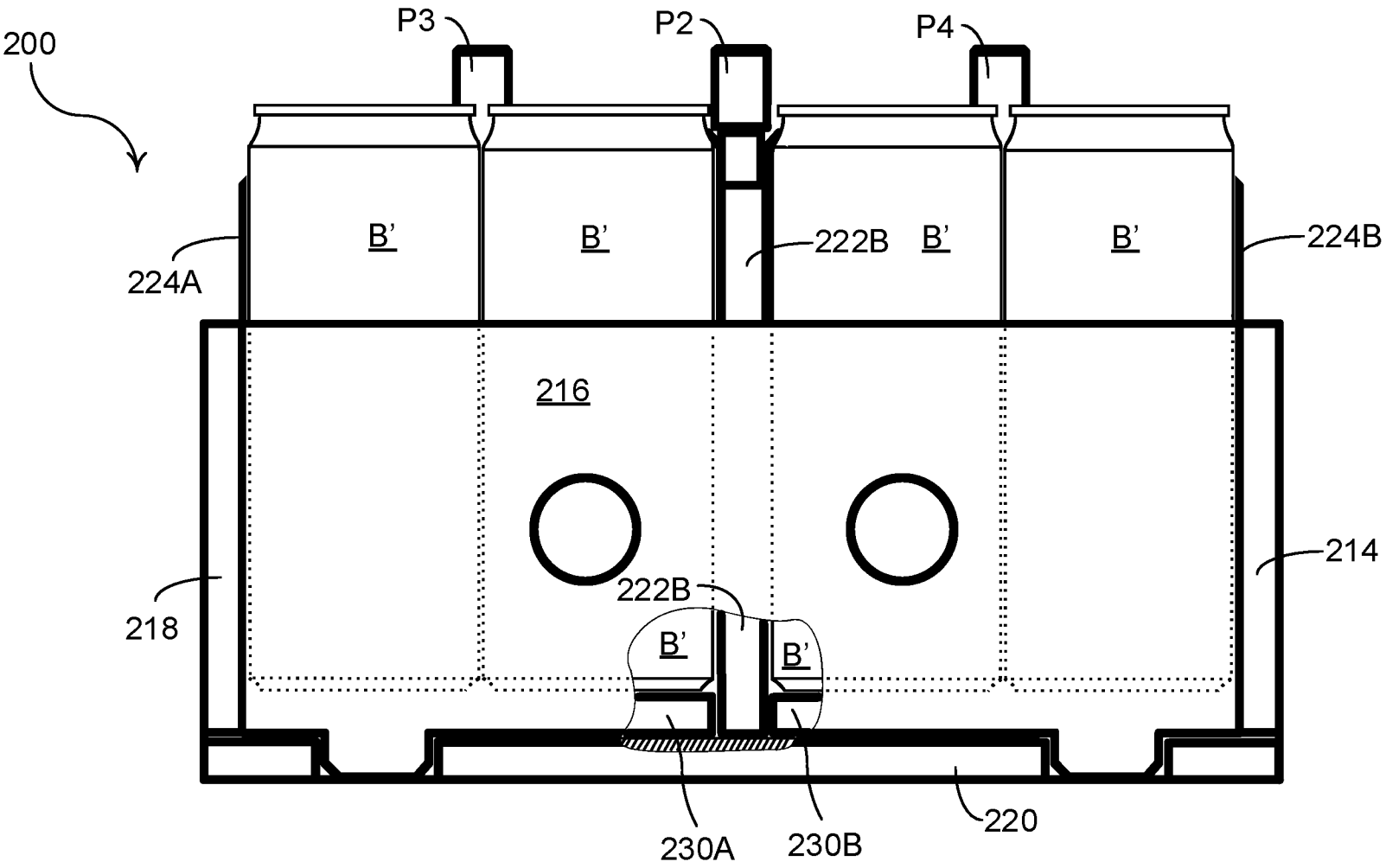
FIG. 14 is an end view of a metering component according to an alternative embodiment loaded with a plurality of articles, a portion of the end wall has been removed or omitted for illustrative purposes.

Referring now to FIGS. 13 and 14, there is shown in FIG. 13 an end view of the loaded base 100 according the first embodiment and in FIG. 14 there is shown an end view of the loaded base 100 according a second embodiment. In the second illustrated embodiment, like numerals have, where possible, been used to denote like parts, albeit with the addition of the prefix "200" to indicate that these features belong to the second embodiment. The second embodiment shares many common features with the embodiment of FIGS. 1 to 13 and therefore only the differences from the embodiment illustrated in FIGS. 1 to 13 will be described in any greater detail.

As shown in FIG. 14 the metering component 200 comprises a plurality of external walls including opposed sidewall 214, 218 and opposed end walls 216 and a base panel 220 which define a tray having an interior. The metering component 200 comprises an open top. The metering component 200 comprises a plurality of internal walls 222B, 224A, 224B which divide the interior of metering component 200 in to a plurality of chambers, in the illustrated embodiment the metering component 200 comprises four chambers. The plurality of internal walls 222B, 224A, 224B form a metering device in the tray.

A plurality of articles B' are be loaded into the interior of the metering component 200. A plurality of article groups are thus formed.

In the embodiment of FIG. 13 the plurality of articles B are be loaded directly onto the base panel 120. In the embodiment of FIG. 14 the articles B' are shorter in height than the articles B of FIG. 13. The article groups are loaded onto a riser 230B, 230B. A riser 230A, 230B is placed in each of the plurality of chambers of the metering component 200. The risers 230A, 230B are disposed upon respective portions of the base panel 220. In this way the risers 230A, 230B elevate the articles B' to sufficiently to interact correctly with the applicator 30. The risers 230A, 230B may be arranged to have a thickness substantially equal to the difference in height dimension between articles B' of FIG. 14 and article B of FIG. 13.

In other embodiments, the articles B' may be elevated by two or more risers arranged to be stacked one upon the other.

Figure 15:
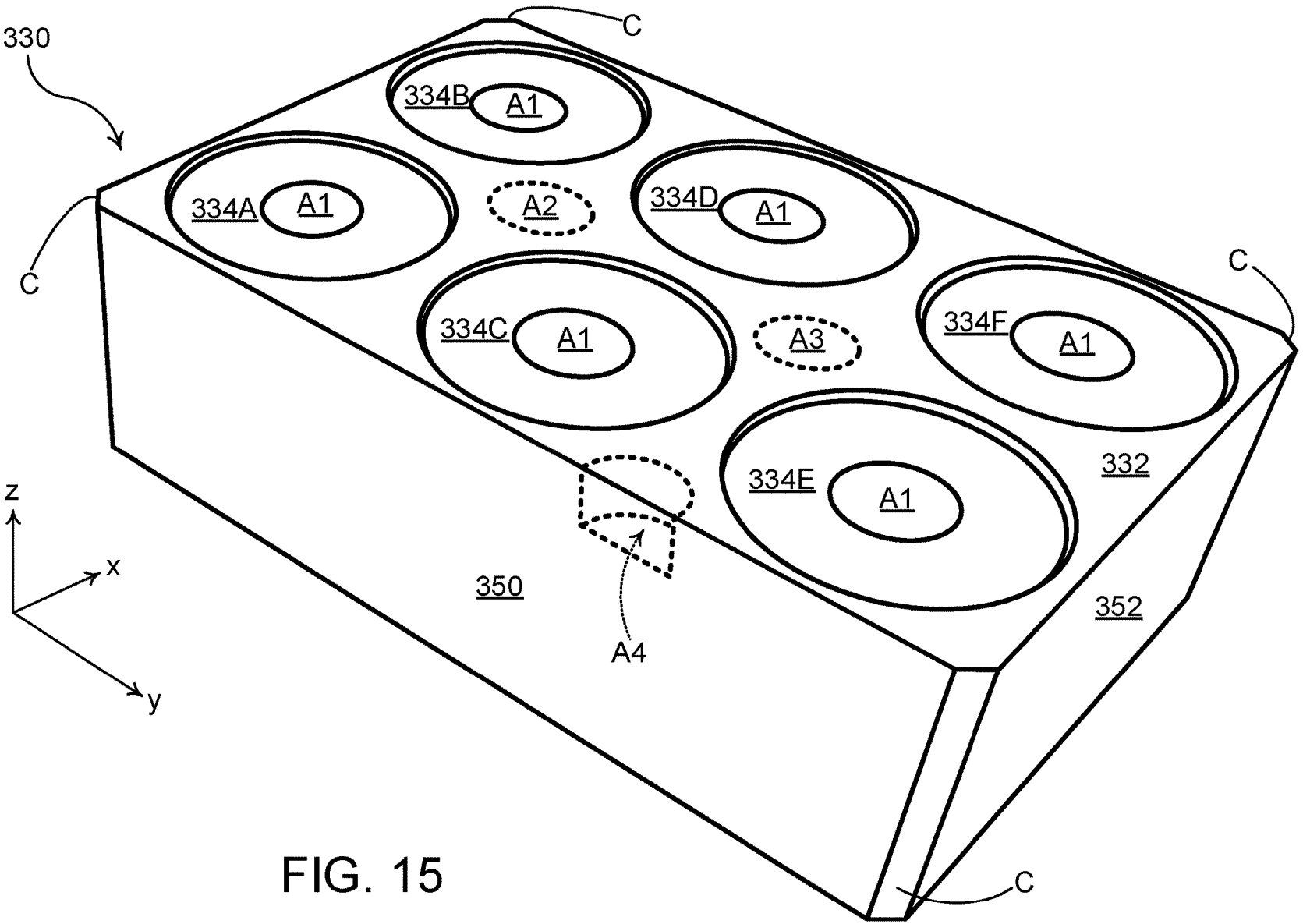
FIG. 15 is a perspective view of a spacer component for use with a metering component of the present disclosure.
Figure 16:
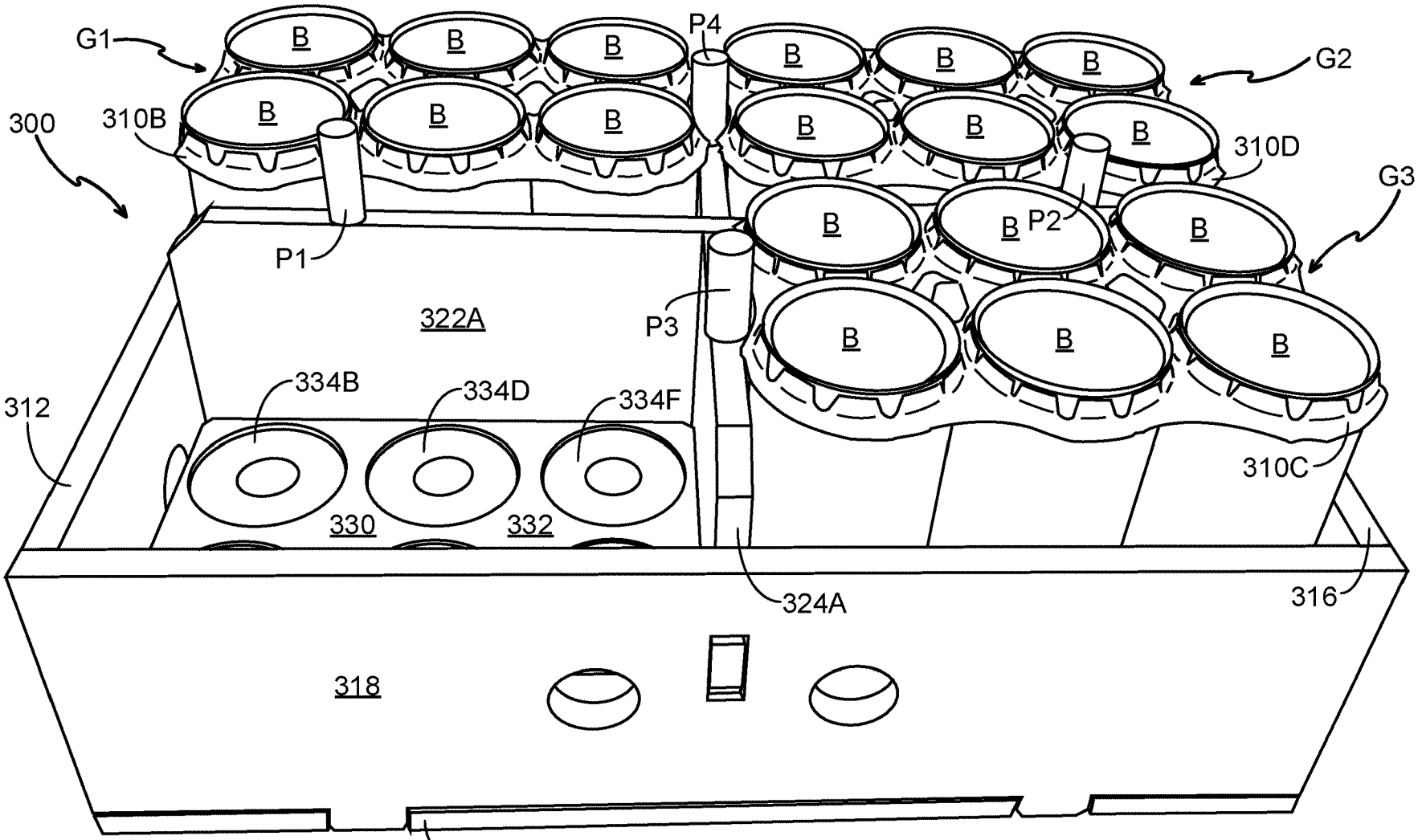
FIG. 16 is a perspective view from above of a metering component according to another embodiment partially loaded with a plurality of articles plurality of packages and employing the spacer component of FIG. 15.
Figure 17:
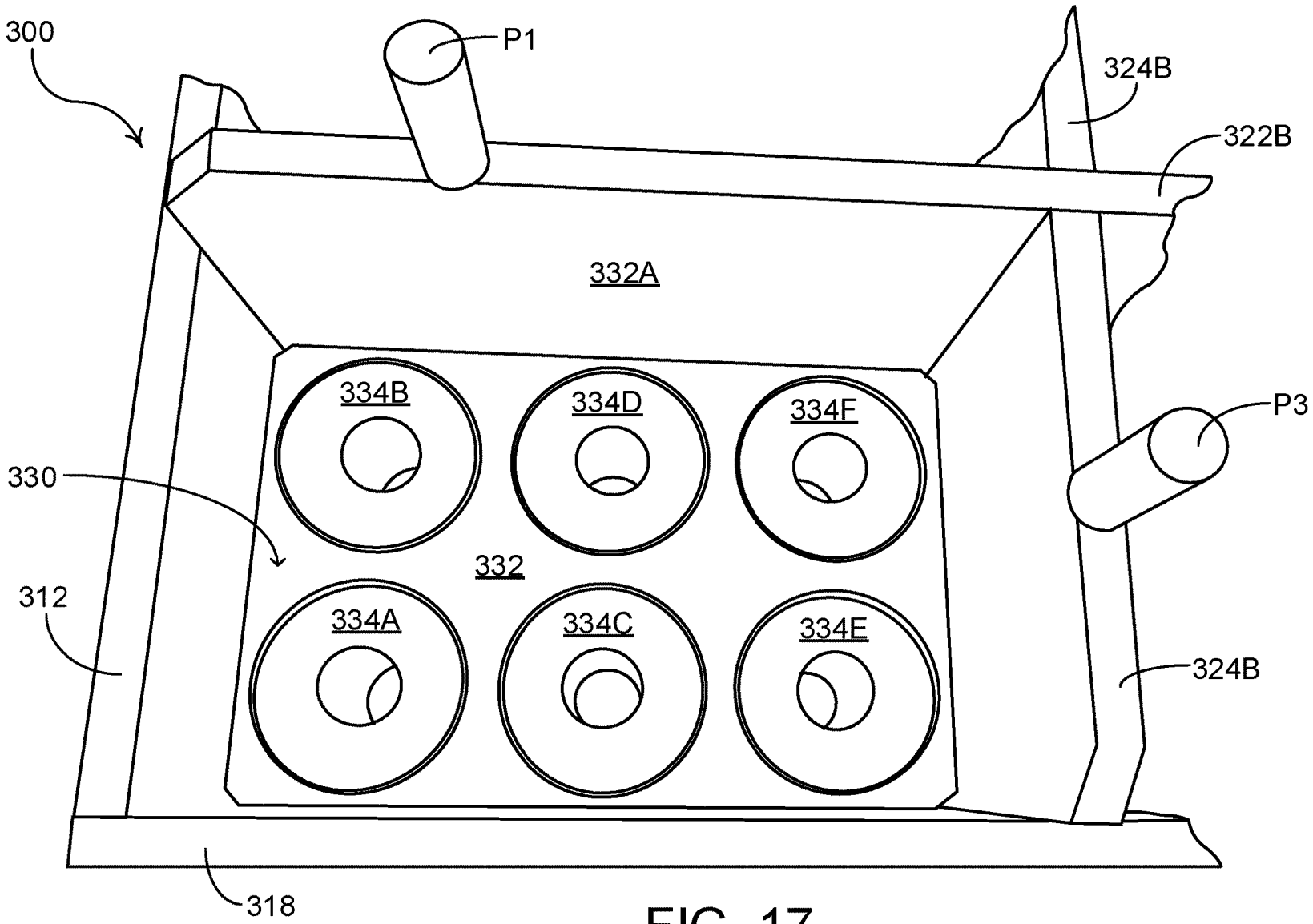
FIG. 17 is an enlarged view of a portion of the metering component of FIG. 16.

Referring now to FIGS. 15 to 17, there is shown an alternative embodiment of the present disclosure. In the third illustrated embodiment, like numerals have, where possible, been used to denote like parts, albeit with the addition of the prefix "300" to indicate that these features belong to the third embodiment. The third embodiment shares many common features with the previous embodiments and therefore only the differences from the embodiments illustrated in FIGS. 1 to 14 will be described in any greater detail.

FIG. 15 shows a perspective view of a spacer component or riser 330. The riser 330 is formed generally as a rectangular cuboid; in alternative embodiments other shapes may be employed. The riser 330 may comprise beveled, chamfered or otherwise filleted corners C between side walls 350 and end walls 352. The beveled corners C may facilitate insertion and removal of the riser 330 into the metering component 300, see FIG. 16.

The riser 330 comprises a top wall or upper surface 332 and a bottom wall or lower surface. The upper surface 332 comprises at least one article locator 334*a*, 334*b*, 334*c*, 334*d*, 334*e*, 334*f*. The article locators 334*a*, 334*b*, 334*c*, 334*d*, 334*e*, 334*f* take the form of a recess or orifice which is at least partially blind.

The article positioners or locators 334*a*, 334*b*, 334*c*, 334*d*, 334*e*, 334*f* define positions or locations upon the upper surface 332 of the riser at which an article B is to be placed or received. In the illustrated embodiment the riser 330 comprises six article locators 334*a*, 334*b*, 334*c*, 334*d*, 334*e*, 334*f* arranged in a 3×2 matrix or array; other arrangements may be employed in other embodiments.

The article locators 334*a*, 334*b*, 334*c*, 334*d*, 334*e*, 334*f* provide positioning devices; controlling the position of articles with respect to each other, controlling the position of articles with respect to the interior or chambers of the tray or controlling the position of articles with respect to each other and the interior or chambers of the tray. Each recess of the article locators 334*a*, 334*b*, 334*c*, 334*d*, 334*e*, 334*f* comprises or provides an upstanding wall for aligning the articles B. In alternative embodiments the article locators 334*a*, 334*b*, 334*c*, 334*d*, 334*e*, 334*f* may comprise a plurality of projections from the upper surface 332 of the riser 330, each projection provides an upstand or wall for aligning one or more articles.

In some embodiments a single projection may be adapted and arranged to align or engage two or more articles so as to simultaneously align said two or more articles.

The projections may be integral with the riser 330 or may be mounted thereto with suitable fixings or attachments.

In still other embodiments, the riser 330 may be formed in two parts; a first part may provide the spacing function raising the articles up from the base of the metering component 300. A second component may be disposed upon the first component and provide the alignment function. The second part may be formed as a plate comprising apertures extending therethrough. When the second component is disposed upon the upper surface of the first component the articles may be received in the apertures of the second component and the bases of the articles may rest upon an upper surface of the first component accessible through the apertures in the plate. The second component may be affixed to the first component or may be separate therefrom, placed at rest upon the first component. In this way the second component may be readily swapped to accommodate articles having a different size, shape or arrangement.

The recesses of the article locators 334*a*, 334*b*, 334*c*, 334*d*, 334*e*, 334*f* are dimensioned to accommodate a lower end portion of an article B. The recesses may provide a close fit and may increase stability of the articles B during the application of carton blanks 10*a*, 10*b*, 10*c*, 10*d* to the articles B in the metering component 300.

The riser 330 may comprise at least one handling device to facilitate insertion and removal of the riser 330 into the metering component 300, in the illustrated embodiment the handling device takes the form of a finger or tool opening A1 disposed in the upper surface 332. The finger opening A1 may define a bore extending through the riser 330 from the upper surface 332 to the lower surface. In other embodiments the finger opening A1 may be blind at a lower end.

In the illustrated embodiment a finger opening A1 is provided or located in each of the recesses of the article locators 334*a*, 334*b*, 334*c*, 334*d*, 334*e*, 334*f*.

A user or machine may insert a finger or tool into an opening A1 to engage the riser 330, for example but not limited to, a user may insert an index finger into a first one of the openings A1 and a thumb into a second one of the openings A1 to grasp the riser 330.

In other embodiments the openings of the handling device may be provided in different locations, as illustrated in FIG. 15 with dashed lines, for example, but not limited to, a first opening A2 disposed between a first group of four adjacent recesses and a second opening A3 disposed between a second group of four adjacent recesses. The first and second openings A2, A3 may be disposed on opposite sides of a column of a pair of article locators, such as the central column of article locators 334*c*, 334*d*. Alternatively, the first and second openings may be disposed on opposite sides of a row of article locators 334*a*, 334*b*, 334*c*, 334*d*, 334*e*, 334*f*.

Optionally, the handling device may comprise at least one cutaway or cutout A4 struck from or defined in an edge of the riser 330, as illustrated in FIG. 15 with dashed lines. A user may grasp the riser 330 between finger and thumb using the cutout A4 and the second opening A3, or a proximate one of the openings A1.

FIG. 16 shows a metering component 300 in which a riser 330 is placed in each of the chambers of the metering component 300. Three of the chambers are illustrated loaded with articles B to which a carton blank 310*b*, 310*c*, 310*d* has been applied to form an article carrier. For illustrative purposes a riser 330 is shown in an empty chamber-articles B and blank have been omitted, the riser 330 is at rest upon an upper surface of the base of the metering component 300, best shown in FIG. 17.

In alternative embodiments the article positioning device 334*a*, 334*b*, 334*c*, 334*d*, 334*e*, 334*f* may be formed as projections or attachments mounted to the upper surface 332 of the riser 330. The projections may be integral with the riser 330 or may be attached by suitable fixing means.

Each article positioning device 334*a*, 334*b*, 334*c*, 334*d*, 334*e*, 334*f* need not fully surround or encircle the article being positioned. For example, a plurality of projections may be provided spaced apart about an article B so as to restrict movement in lateral and longitudinal directions x, y.

The present disclosure provides a method and apparatus for forming carrier of the top engaging type having improved article retention structures. In particular, the retention structures comprise article engaging tabs which yield upon insertion of an article. The tabs engage with an article to hold or secure the article within a panel of the carrier. The construction of the tabs is dependent upon the location of the tabs within the panel of the carrier. Those tabs subject to the greatest stress, typically those disposed in the interior regions of the panel or in close proximity to a tab of an adjacent retention structure, are provided with a stress relieving mechanism in the form of cutlines. The cutlines are provided proximate the side edge of the tabs and interrupt or define a fold line between the tab and the panel from which it is struck or formed.

The carrier is formed from a blank which is adapted to be applied to a group of articles simultaneously with at least one further blank which is similarly arranged. The blank and further blanks being severably from each other upon application to their respective groups of articles. The blank comprises a projecting edge forming a border or brim which surrounds the group of articles which it accommodates.

The present disclosure provides an apparatus for grouping articles and/or metering the articles. The apparatus holds the articles in one or more groups in order to apply a carton blank or plurality of carton blanks to the one or more groups. An applicator applies the carton blank or blanks to the one or more groups.

The apparatus may comprise spacer structure for spacing groups of articles apart.

The present disclosure provides a riser for receiving one or more articles of an article group. The riser may comprise an article positioning device for aligning or locating the articles in predefined position relative to a chamber of the apparatus.

It can be appreciated that various changes may be made within the scope of the present invention. For example, the size and shape of the panels and apertures may be adjusted to accommodate articles of differing size or shape. The metering base may employ the riser feature without a spacer structure to space apart groups of articles, for example, but not limited to, when packaging articles or cans having a non-sleek design, such as standard diameter beverage cans.

It will be recognised that as used herein, directional references such as "top", "bottom", "base", "front", "back", "end", "side", "inner", "outer", "upper" and "lower" do not necessarily limit the respective panels to such orientation, but may merely serve to distinguish these panels from one another.

As used herein, the terms "hinged connection" and "fold line" refer to all manner of lines that define hinge features of the blank, facilitate folding portions of the blank with respect to one another, or otherwise indicate optimal panel folding locations for the blank. Any reference to "hinged connection" should not be construed as necessarily referring to a single fold line only; indeed a hinged connection can be formed from two or more fold lines wherein each of the two or more fold lines may be either straight/linear or curved/curvilinear in shape. When linear fold lines form a hinged connection, they may be disposed parallel with each other or be slightly angled with respect to each other. When curvilinear fold lines form a hinged connection, they may intersect each other to define a shaped panel within the area surrounded by the curvilinear fold lines. A typical example of such a hinged connection may comprise a pair of arched or arcuate fold lines intersecting at two points such that they define an elliptical panel therebetween. A hinged connection may be formed from one or more linear fold lines and one or more curvilinear fold lines. A typical example of such a hinged connection may comprise a combination of a linear fold line and an arched or arcuate fold line which intersect at two points such that they define a half moon-shaped panel therebetween.

As used herein, the term "fold line" may refer to one of the following: a scored line, an embossed line, a debossed line, a line of perforations, a line of short slits, a line of half-cuts, a single half-cut, an interrupted cutline, a line of aligned slits, a line of scores and any combination of the aforesaid options.

It should be understood that hinged connections and fold lines can each include elements that are formed in the substrate of the blank including perforations, a line of perforations, a line of short slits, a line of half-cuts, a single half-cut, a cutline, an interrupted cutline, slits, scores, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The phrase "in registry with" as used herein refers to the alignment of two or more elements in an erected carton, such as an aperture formed in a first of two overlapping panels and a second aperture formed in a second of two overlapping panels. Those elements in registry with each other may be aligned with each other in the direction of the thickness of the overlapping panels. For example, when an aperture in a first panel is "in registry with" a second aperture in a second panel that is placed in an overlapping arrangement with the first panel, an edge of the aperture may extend along at least a portion of an edge of the second aperture and may be aligned, in the direction of the thickness of the first and second panels, with the second aperture.

The invention claimed is:

1. A device for applying a plurality of top-engaging carriers to groups of articles respectively, the device comprising: a metering base for facilitating arranging a plurality of articles into groups of articles; and an applicator for pressing top-engaging carriers onto groups of articles respectively, the metering base comprising:

a spacer structure for maintaining a predetermined space between each group of articles and at least a next adjacent group of articles; and a first aligning feature;

wherein the applicator comprises:

an applicator plate;

a plurality of receiving cavities in the applicator plate each for receiving a top of an article; and a second aligning feature for engaging the first aligning feature for sliding movement with each other.

2. A device according to claim 1 wherein the plurality of top-engaging carriers comprises a set of connected blanks each for forming a top engaging carrier, wherein the blanks are detachably connected together in a matrix fashion wherein each blank has a plurality of top-receiving apertures.

3. A device according to claim 2 wherein the applicator comprises a separation device for severing frangible connections between adjacent ones of the set of connected blanks.

4. A device according to claim 1 wherein the applicator comprises an end stop for limiting travel of the applicator with respect to one of: the articles or the metering base.

5. A device according to claim 4 wherein each of the plurality of receiving cavities in the applicator plate comprises a hole at least partially closed at an upper end thereof.

6. A device according to claim 1 comprising at least one riser for elevating one or more articles above a base panel of the metering base.

7. A device according to claim 6 wherein the riser comprises at least one article positioning device for aligning at least one article.

8. A device according to claim 7 wherein the at least one article positioning device comprises a recess defined in an upper surface of the riser.

9. A device according to claim 8 wherein the riser comprises at least one handling device comprising an orifice disposed in the recess of the at least one article positioning device.

10. A device according to claim 7 wherein the riser comprises at least one handling device for aligning an article located within said at least one article positioning device.

11. A device according to claim 7 wherein the at least one article positioning device comprises an upstanding wall defined in an upper surface of the riser.

12. A device according to claim 6 wherein the riser comprises at least one handling device for aligning an article.

13. A device according to claim 12 wherein the at least one handling device comprises one of the following: (a) a pair of orifices in the upper surface of the riser, (b) a pair of cutaways in the upper surface of the riser, and (c) a cutout and an orifice defined in the upper surface of the riser.

14. A method of applying a plurality of top-engaging carriers to groups of articles respectively, the method comprising:

(a) providing an application device of claim 1;

(b) providing a plurality of top-engaging carriers;

(c) placing a plurality of articles into contact with the metering base, whereby arranging the plurality of articles into a plurality of spaced apart groups;

(d) placing the top-engaging carriers over the groups of articles such that the top engaging carriers are guided by the first aligning feature into vertical alignment with the groups of articles respectively;

(e) placing the applicator over the top-engaging carriers such that the first and second aligning features are in engagement with each other to bring the cavities into vertical alignment with the tops of the articles of the groups respectively;

(f) lowering the applicator with respect to the groups of articles so that the top of each article of the groups are received in a respective one of the cavities whereby the top-engaging carriers are also lowered into engagement with the groups of articles respectively; and (g) lifting the applicator to separate the applicator from the groups of articles to which the top-engaging carriers have been applied respectively.

15. A method according to claim 14 wherein the step of providing a plurality of top-engaging carriers comprises providing a set of connected blanks each for forming a top engaging carrier, wherein the blanks are detachably connected together in a matrix fashion wherein each blank has a plurality of top-receiving apertures.

16. A method according to claim 15 wherein the set of connected blanks comprises two or more alignment openings, wherein the first aligning feature comprises two or more posts projecting upward from the metering base, wherein the step of placing the top-engaging carriers over the groups of articles comprises resting the set of connected blanks upon the articles such that the posts are received in the alignment openings respectively.

17. A method according to claim 16 wherein the alignment openings are provided by cutaways defined in the set of connected blanks, wherein the cutaways are provided in edges of the blanks such that the openings are disposed between a pair of adjacent ones of the blanks.

18. A method according to claim 17 wherein the alignment openings each is struck in part from each of the pair of adjacent ones of the blanks.

19. A method according to claim 16 wherein the alignment openings each is provided by a handle aperture in the blanks.

20. A method according to claim 14 wherein the step of lowering the applicator with respect to the groups of articles comprises separating the set of connected blanks from each other.

* * * * *